US011603277B2

(12) United States Patent
Maeda

(10) Patent No.: US 11,603,277 B2
(45) Date of Patent: Mar. 14, 2023

(54) SHEET-SHAPED-MEDIUM FEEDER AND HANDLING APPARATUS

(71) Applicant: FUJIFILM Business Innovation Corp., Tokyo (JP)

(72) Inventor: Shoichi Maeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 19 days.

(21) Appl. No.: 17/460,433

(22) Filed: Aug. 30, 2021

(65) Prior Publication Data

US 2022/0371841 A1 Nov. 24, 2022

(30) Foreign Application Priority Data

May 24, 2021 (JP) ..... JP2021-086860

(51) Int. Cl.

| | |
|---|---|
| ***B65H 7/16*** | (2006.01) |
| ***B65H 1/08*** | (2006.01) |
| ***B65H 3/48*** | (2006.01) |
| ***B65H 7/06*** | (2006.01) |

(52) U.S. Cl.

CPC ..... *B65H 7/16* (2013.01); *B65H 1/08* (2013.01); *B65H 3/48* (2013.01); *B65H 7/06* (2013.01)

(58) Field of Classification Search

CPC ... B65H 1/08; B65H 1/14; B65H 1/18; B65H 3/08; B65H 3/0816; B65H 3/34; B65H 3/48; B65H 3/54; B65H 7/02; B65H 7/06; B65H 7/14; B65H 7/16; B65H 2301/51256; B65H 2406/10; B65H 2406/12; B65H 2406/121; B65H 2601/22

See application file for complete search history.

(56) References Cited

U.S. PATENT DOCUMENTS

| | | | | |
|---|---|---|---|---|
| 2006/0012107 | A1* | 1/2006 | Ueda | B65H 3/128 271/30.1 |
| 2010/0038843 | A1* | 2/2010 | Marasco | B65H 7/00 271/152 |
| 2012/0161384 | A1* | 6/2012 | Suzuki | B65H 3/48 271/11 |
| 2020/0031599 | A1* | 1/2020 | Okano | B65H 1/266 |

FOREIGN PATENT DOCUMENTS

| | | | |
|---|---|---|---|
| JP | 2008-222404 | A | 9/2008 |
| JP | 2013-166642 | A | 8/2013 |
| JP | 2020-15607 | A | 1/2020 |

* cited by examiner

*Primary Examiner* — Prasad V Gokhale
(74) *Attorney, Agent, or Firm* — Oliff PLC

(57) ABSTRACT

A feeder includes: a mount board that moves vertically while allowing sheet-shaped media to be stacked thereon; a transport device that allows an uppermost one of the sheet-shaped media stacked on the mount board to be sucked by a suction portion to transport the uppermost sheet-shaped medium to a transporter and to feed the uppermost sheet-shaped medium to a destination; left and right edge air blowers that blow air to left and right edge portions, when viewed from an upstream side in a transportation direction, of upper ones of the sheet-shaped media stacked; and left and right detectors that are disposed on left and right sides of the suction portion at the same position in the transportation direction, and that individually detect downward or upward bend amounts of left and right edge portions of the uppermost sheet-shaped medium.

20 Claims, 25 Drawing Sheets

SHEET-SHAPED-MEDIUM FEEDER AND HANDLING APPARATUS

CROSS-REFERENCE TO RELATED APPLICATIONS

This application is based on and claims priority under 35 USC 119 from Japanese Patent Application No. 2021-086860 filed May 24, 2021.

BACKGROUND

(i) Technical Field

The present disclosure relates to a sheet-shaped-medium feeder and a handling apparatus.

(ii) Related Art

Japanese Unexamined Patent Application Publication No. 2013-166642 (for example, claim 1 and FIGS. 10 and 11) describes a sheet feeder that receives a stack of sheets on a sheet mount, and sucks air through a vent of a sheet transporting member to transport the sheets of the stack while sucking each sheet with the sheet transporting member. A space between the sheet transporting member and a guide disposed below the sheet transporting member forms an opening through which a sheet transported by the sheet transporting member passes. The guide has a center portion extending in a direction orthogonal to a sheet transportation direction and side portions disposed on both sides of the center portion. The side portions are lower than the center portion at the opening closer to a sheet inlet.

Japanese Unexamined Patent Application Publication No. 2020-15607 (for example, paragraphs 0020 to 0043 and 0052, and FIGS. 3, 4, and 7) describes a sheet feeder including a sheet mount, a tip-end air blower, a side-edge air blower, a suction let-off portion, a transporter, and a curl detection sensor. The sheet mount receives a stack of multiple sheets and is supported to be vertically movable. The tip-end air blower includes a nozzle to blow air in a direction slightly inclined upward with respect to a downstream side of a sheet feeding direction. The side-edge air blower includes a nozzle to blow air in, for example, a horizontal direction toward sheets from right and left sides of the uppermost sheet located at a restricted height. The suction let-off portion includes a belt mechanism and a suction duct located inside the belt to suck and feed the uppermost sheet. The transporter includes an insertion guide and a transport roller that transports a sheet fed by the suction let-off portion in the sheet feeding direction. The curl detection sensor includes a center sensor and an end sensor.

SUMMARY

Aspects of non-limiting embodiments of the present disclosure relate to a sheet-shaped-medium feeder and a handling apparatus capable of transporting sheet-shaped media while reducing errors and failures in transporting the sheet-shaped media regardless of when the sheet-shaped media mounted on a mount board have transportation left and right edge portions bent downward or upward, unlike a feeder or an apparatus that merely sucks and transports sheet-shaped media with, for example, the left and right edge portions not bent downward or upward.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a feeder that includes: a mount board that moves vertically while allowing sheet-shaped media to be stacked thereon; a transport device that allows an uppermost one of the sheet-shaped media stacked on the mount board to be sucked by a suction portion to transport the uppermost sheet-shaped medium to a transporter and to feed the uppermost sheet-shaped medium to a destination; left and right edge air blowers that blow air to left and right edge portions, when viewed from an upstream side in a transportation direction, of upper ones of the sheet-shaped media stacked; and left and right detectors that are disposed on left and right sides of the suction portion at the same position in the transportation direction, and that individually detect downward or upward bend amounts of left and right edge portions of the uppermost sheet-shaped medium, wherein, when either one or both of the left and right detectors detect that the downward bend amount is greater than or equal to a specific amount, the feeder performs a first operation of reducing a height difference at a portion of the uppermost sheet-shaped medium in a transportation width direction.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings.

First Exemplary Embodiment

Figure 1:
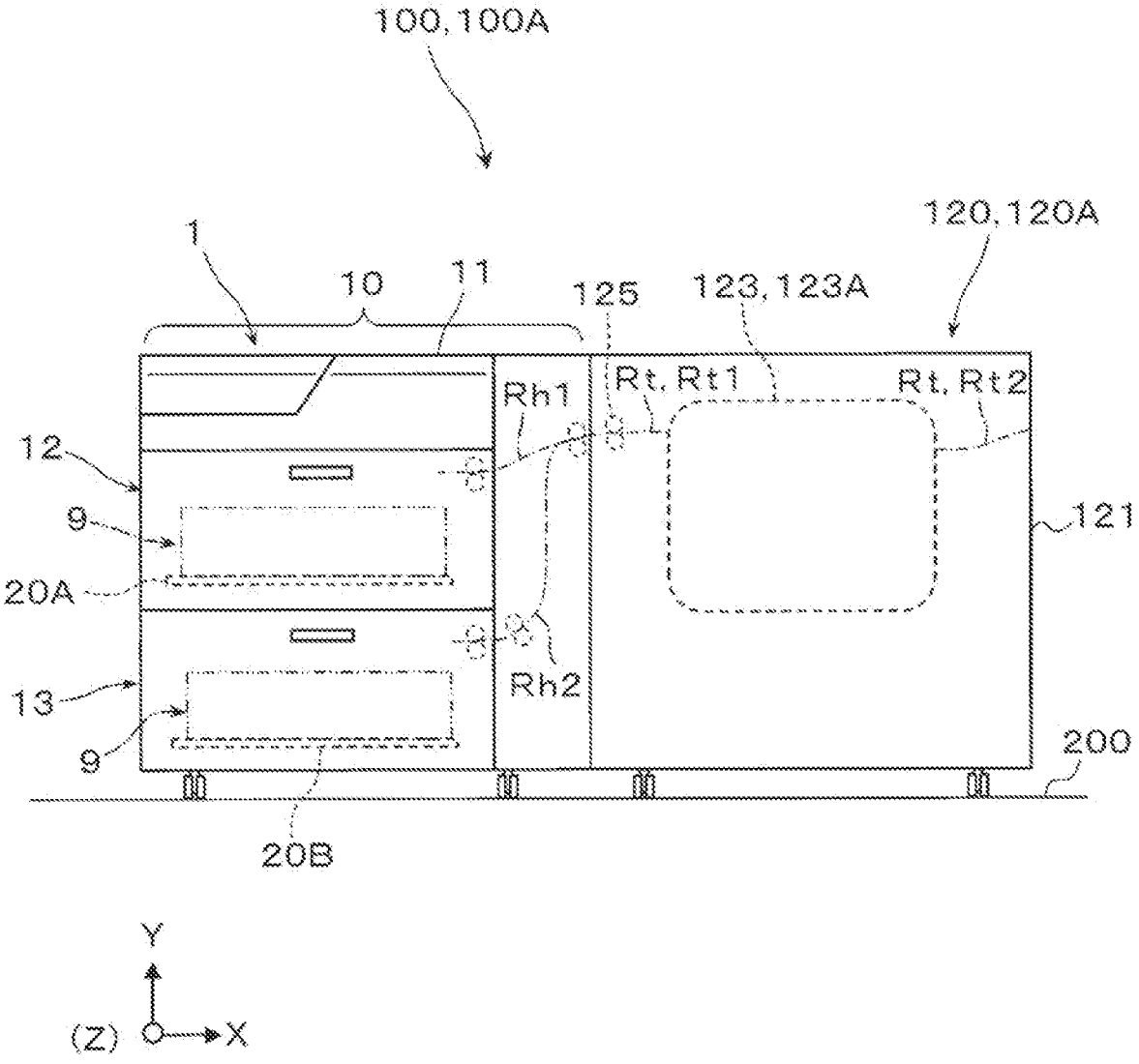
FIG. 1 is a side view of a sheet-shaped-medium handling apparatus according to a first exemplary embodiment.
Figure 2:
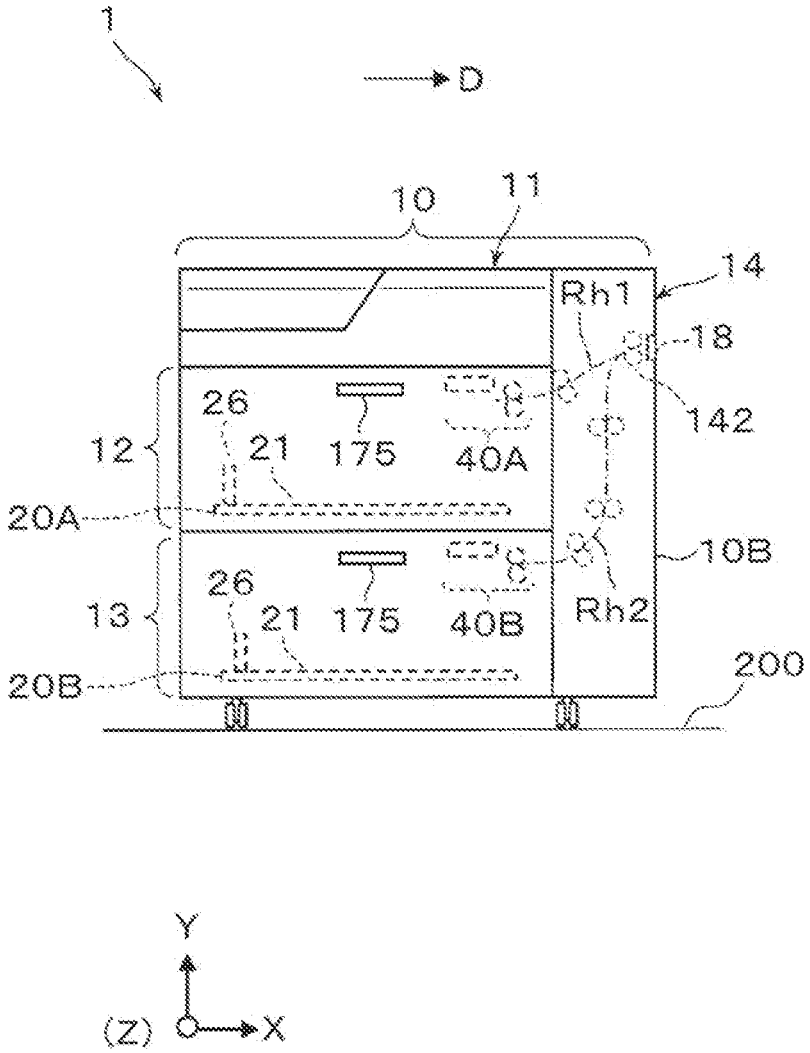
FIG. 2 is a side view of a sheet-shaped-medium feeder according to the first exemplary embodiment.

FIG. 1 illustrates a sheet-shaped-medium handling apparatus 100 according to a first exemplary embodiment. FIG. 2 illustrates a sheet-shaped-medium feeder 1 according to the first exemplary embodiment.

In the following description, throughout the drawings, the direction indicated with arrow X is referred to as an apparatus width direction, the direction indicated with arrow Y is referred to as an apparatus height direction, and the direction indicated with arrow Z is referred to as an apparatus depth direction perpendicular to the width direction and the height direction. A circle in the drawings at the intersection of the arrow X and the arrow Y denotes the apparatus depth direction (arrow Z) directing downward from the drawing sheet, or perpendicular to the drawing sheet.

Sheet-Shaped-Medium Handling Apparatus

As illustrated in FIG. 1, the sheet-shaped-medium handling apparatus 100 includes the sheet-shaped-medium feeder 1, which transports and feeds sheet-shaped media 9 stacked thereon, and a processing device 120, which performs processing on the sheet-shaped media 9 fed from the feeder 1.

The sheet-shaped media 9 are sheet-like media that are receivable in and transportable by the feeder 1 and transportable and processible by the processing device 120. An image forming system 100A and other portions are installed on an installation surface 200 illustrated in FIG. 1.

The sheet-shaped-medium handling apparatus 100 includes an image forming apparatus 120A that forms images on the sheet-shaped media 9 to serve as the processing device 120. The processing device 120 is connected to and combined with the feeder 1 to form the image forming system 100A.

Examples used as the sheet-shaped media 9 include recording media that allow images to be formed thereon, such as paper sheets, coated paper, films, foil, and sheet-like cloth cut into predetermined sizes, and envelopes.

As illustrated in FIG. 1, the image forming apparatus 120A, serving as an example of the processing device 120, includes an image forming unit 123A and transport paths Rt inside a housing 121 with a predetermined profile. The image forming unit 123A forms images on the sheet-shaped media 9 and serves as an example of a processing unit 123. Each transport path Rt allows the sheet-shaped media 9 to be transported along itself inside the housing 121.

The image forming unit 123A has, for example, an image forming system such as an electrophotographic system or an inkjet recording system. However, the image forming system, layout, the number of units, and other details of the image forming unit 123A are not limited to particular ones.

An introduction transport path Rt1 indicated with a dot-and-dash line in FIG. 1 allows the sheet-shaped media 9 fed from the feeder 1 to be transported along itself and introduced into the image forming unit 123A. The introduction transport path Rt1 includes transport rollers 125, and a transport guide. A discharge transport path Rt2 indicated with a dot-and-dash line allows the sheet-shaped media 9 that have passed the image forming unit 123A to be transported along itself and discharged to a receiving portion or a post-processing unit, not illustrated. The discharge transport path Rt2 includes transport rollers and a transport guide, not illustrated.

In the image forming system 100A, when the sheet-shaped media 9 are fed from the feeder 1 to the image forming apparatus 120A, which is an example of the processing device 120, the image forming apparatus 120A forms images on the fed sheet-shaped media 9.

Sheet-Shaped-Medium Feeder

As illustrated in FIGS. 1 and 2, the sheet-shaped-medium feeder 1 includes a housing 10 serving as a body accommodating and feeding the sheet-shaped media 9.

Figure 3:
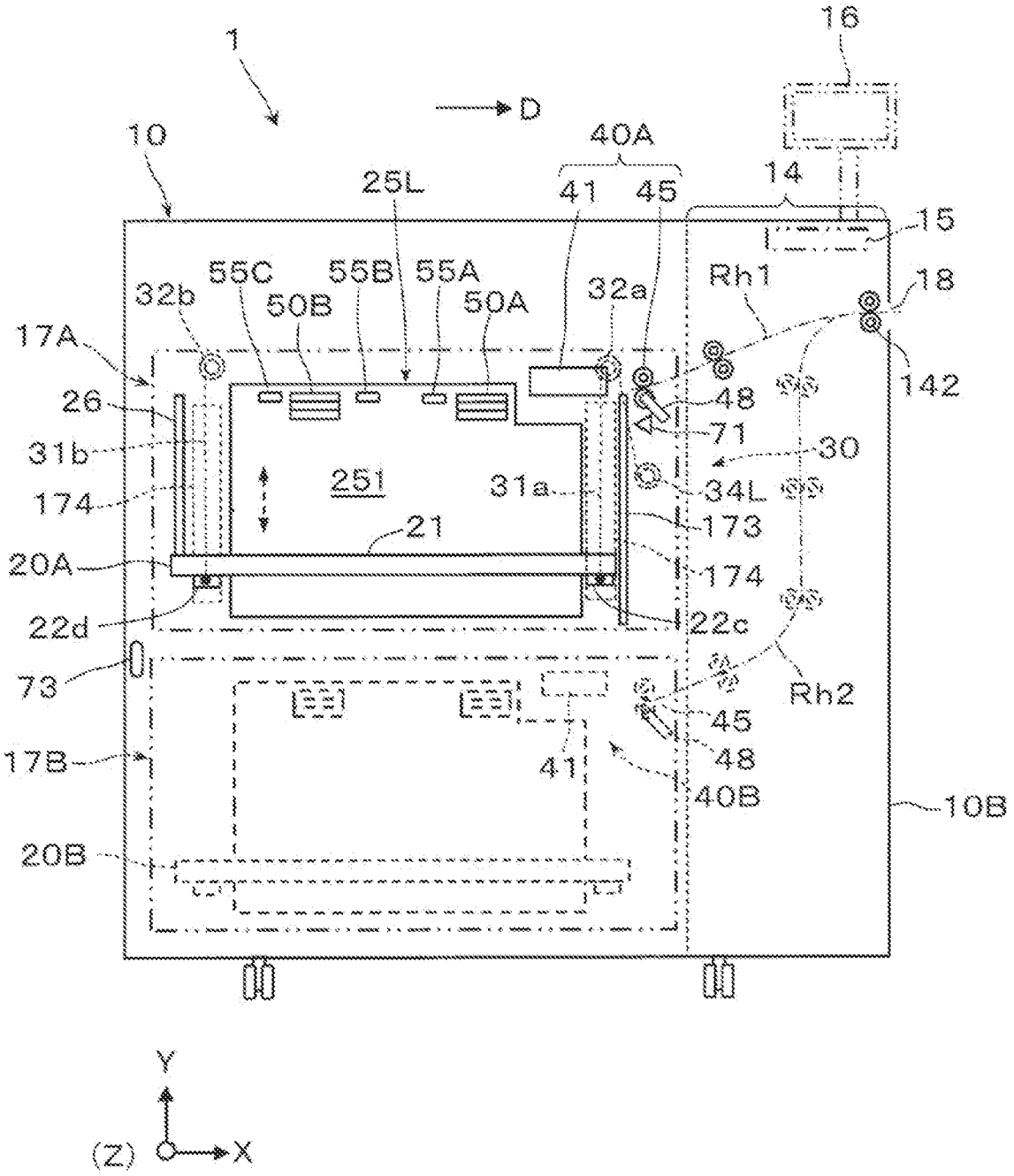
FIG. 3 is a schematic view of an inside of the feeder viewed from a side.

The housing 10 includes a support frame forming a predetermined skeleton structure, and an exterior panel forming the appearance. As illustrated in FIGS. 1 to 3, the housing 10 roughly includes an upper portion 11, feed units 12 and 13 located below the upper portion 11 and vertically stacked one on the other (upper and lower units), and a discharge portion 14 disposed at an end of the upper portion 11 and the feed units 12 and 13 on one side.

As illustrated in FIGS. 1 to 4 and other drawings, the feed unit 12 on the upper side and the feed unit 13 on the lower side include containers 17A and 17B, such as trays, mount portions 20A and 20B that receive the sheet-shaped media 9, lifts 30 that vertically raise and lower the mount portions 20A and 20B inside the containers 17A and 17B, and dischargers 40A and 40B that discharge the sheet-shaped media 9 respectively stacked on the mount portions 20A and 20B toward the discharge portion 14 in the direction of arrow D (in the transportation direction D).

The containers 17A and 17B are attached to be drawable to the near side (upstream side in the apparatus depth direction Z) of the housing 10.

The containers 17A and 17B each include side wall boards at an upstream end and a downstream end in the apparatus depth direction Z, and a body that is open in the apparatus width direction X. On the wall board on the upstream side in the apparatus depth direction Z, a front wall 172 is attached. A pull opening 175 is formed at an upper portion of the front wall 172.

Figure 4:
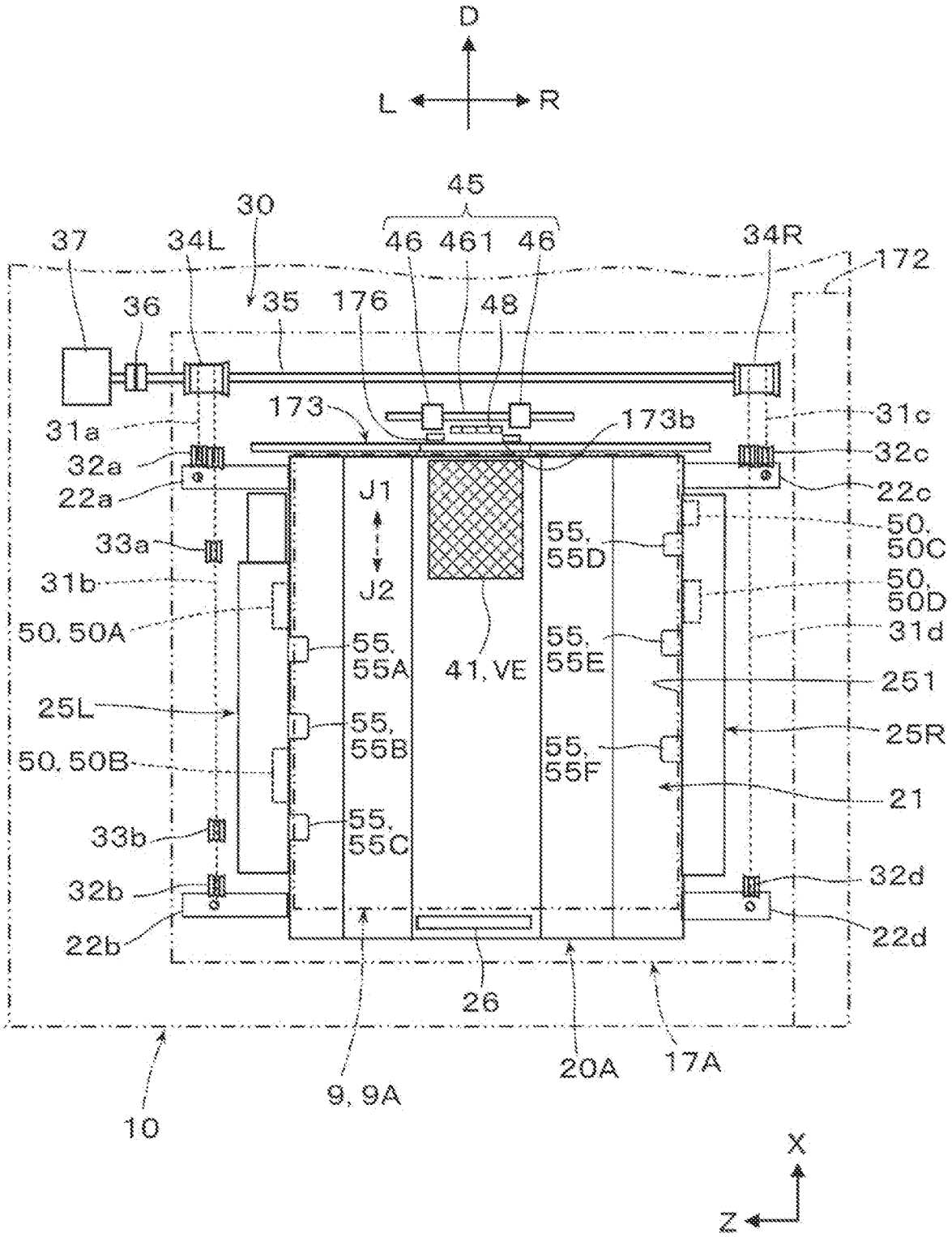
FIG. 4 is a schematic view of the inside of the feeder viewed from above.
Figure 7:
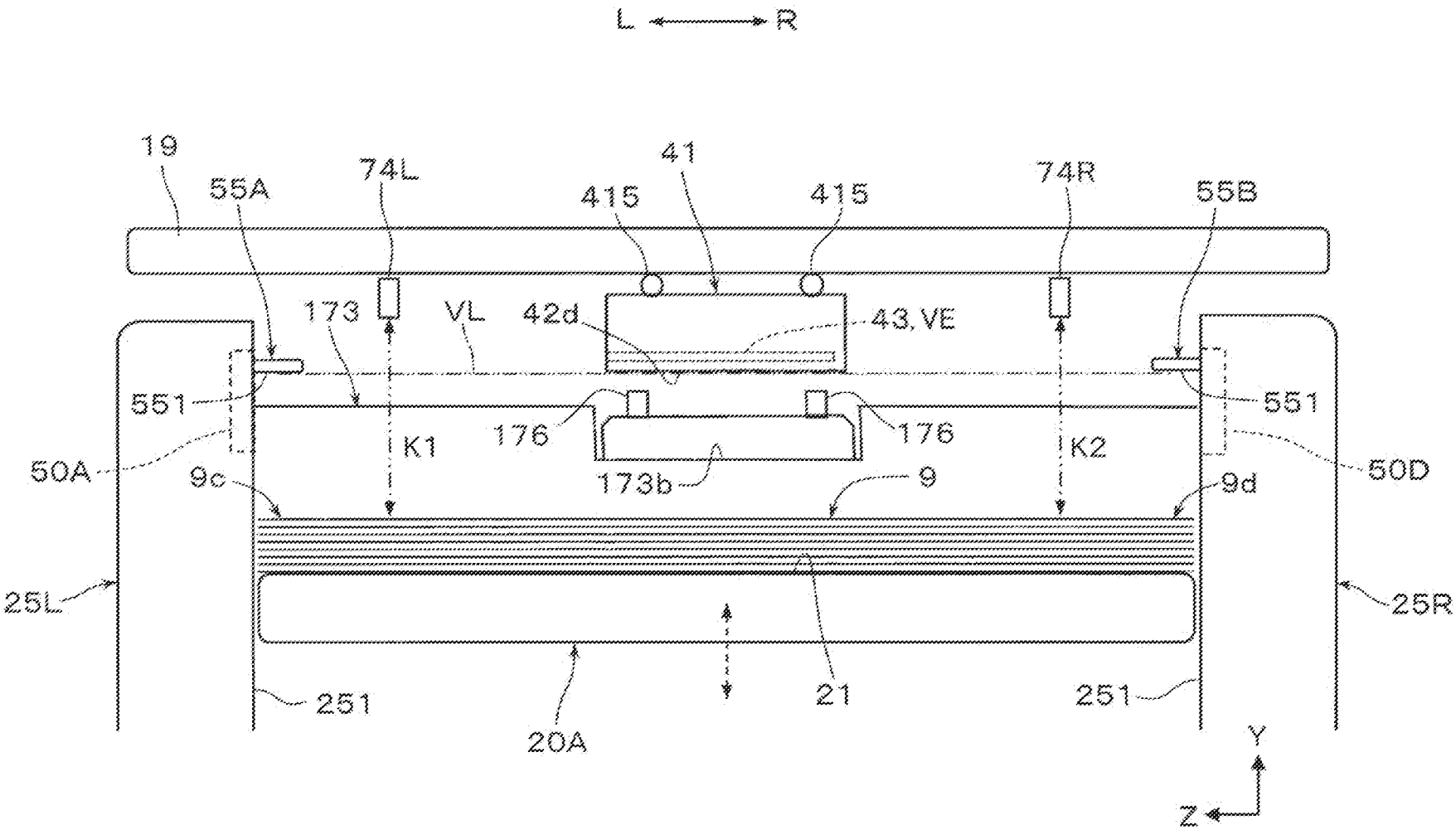
FIG. 7 is a schematic view of components of the feeder such as a suction portion viewed from the upstream side in a transportation direction.

The containers 17A and 17B each include a leading-end wall 173, and a moving device, not illustrated. The leading-end wall 173 is located at one open end (downstream end in the transportation direction D) of the body, and aligns transportation leading ends 9*s* of the sheet-shaped media 9, on the downstream side in the transportation direction D, stacked on the mount portion 20A or 20B for positioning. The moving device includes slide rails and a latch mechanism disposed between the left and right side portions of the body in the pull-out direction and the inner wall of the housing 10. As illustrated in FIGS. 4 and 7, the leading-end wall 173 has a cut recess 173*b* at the middle at the upper end of the leading-end wall 173.

The mount portions 20A and 20B are plate members (mount boards) each having a mount surface 21 that receives the sheet-shaped media 9 on the upper portion. The mount portions 20A and 20B are installed in the containers 17A and 17B to be vertically movable.

The mount portions 20A and 20B have the same structure. Thus, the mount portion 20A will be described below as an example except when particularly needed.

As illustrated in FIGS. 3 and 4 and other drawings, the mount portion 20A includes hanging portions 22*a*, 22*b*, 22*c*, and 22*d* protruding from the left and right edge portions on the left and right sides when viewed from the downstream side in the transportation direction D of the sheet-shaped media 9. The hanging portions 22*a*, 22*b*, 22*c*, and 22*d* are guided along guide holes 174 formed in the side wall boards in the body of the container 17A to be vertically movable. The mount portion 20A is movable by at least vertical dimensions of the guide holes 174.

As illustrated in FIGS. 2 to 4 and other drawings, the mount portion 20A includes left and right side walls 25L and 25R and a rear end wall 26 on the mount surface 21. As illustrated in FIG. 4, the left (L) and right (R) correspond to the left side and the right side when viewed from the upstream side in the transportation direction D.

Figure 5:
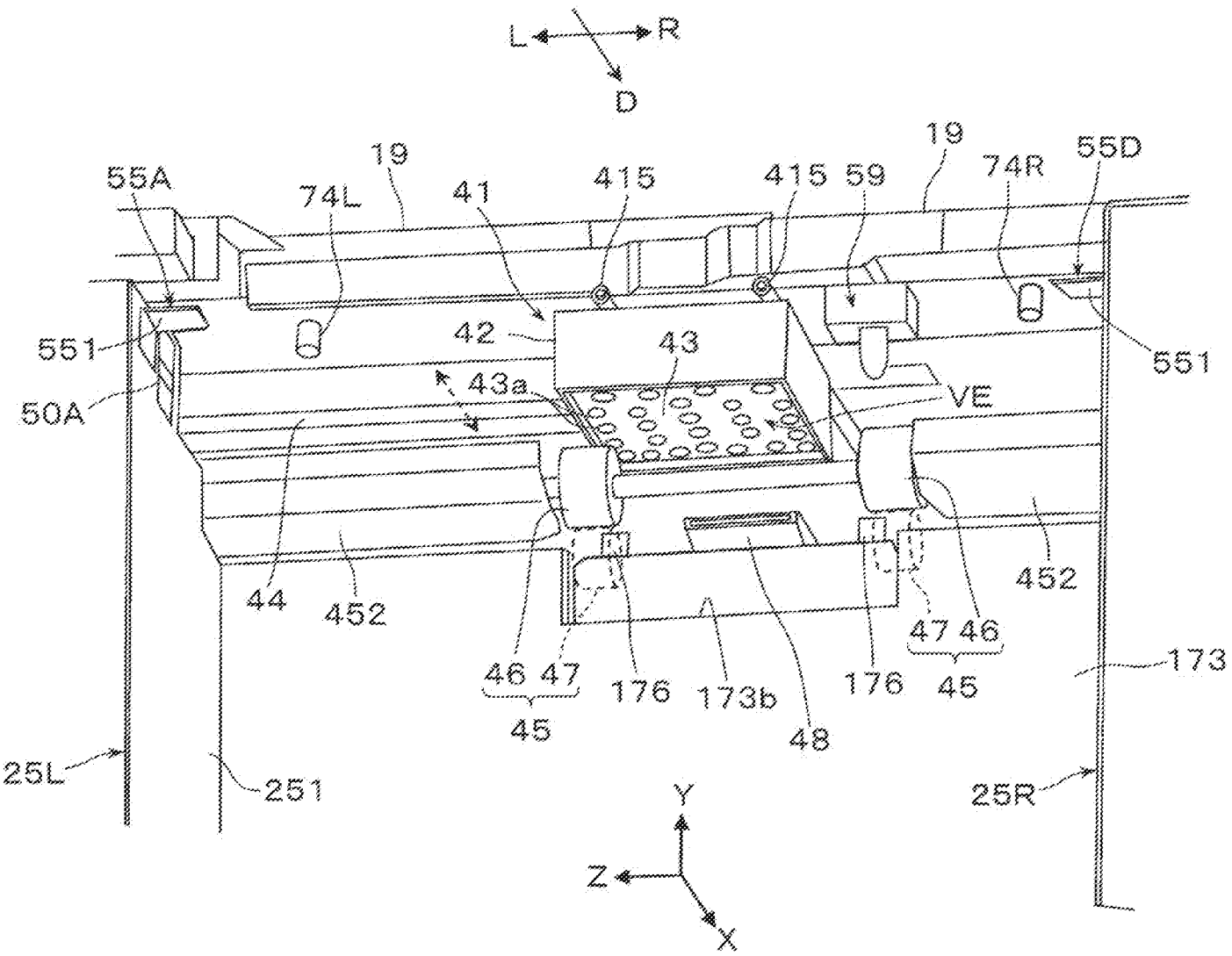
FIG. 5 is a schematic view of components of the feeder such as a suction portion and a transporter viewed from obliquely below.

As illustrated in FIGS. 4 and 5, each of the side walls 25L and 25R includes a contact surface 251 that comes into contact with the left or right edges of the sheet-shaped medium 9 to align and fix the positions of the transportation left and right edge portions of the sheet-shaped medium 9 stacked on the mount surface 21 with the contact surfaces 251, and to guide the left or right edges in the transportation direction D. The feed units 12 and 13 transport the sheet-shaped media 9 while using the center position of the sheet-shaped media 9 in the feed width direction as a reference position for transportation, that is, while employing a center registration method. Thus, the side walls 25L and 25R are movable as a whole in the leftward and rightward directions L and R over the bottom of the containers 17A and 17B.

The rear end wall 26 has a contact surface that comes into contact with the trailing ends of the sheet-shaped media 9. The contact surface aligns the trailing ends of the sheet-shaped media 9, on the upstream side in the transportation direction D, to fix the positions of the trailing ends. The entirety of the rear end wall 26 is movable with respect to slide grooves extending in the transportation direction D and formed in a fixed surface portion (not illustrated) of the mount surface 21.

As shown in FIGS. 3 and 4 and other drawings, the lift 30 includes four wires 31*a*, 31*b*, 31*c*, and 31*d*, winding pulleys 32*a*, 32*b*, 32*c*, and 32*d* and auxiliary pulleys 33*a* and 33*b* around each of which any of the wires 31*a*, 31*b*, 31*c*, and 31*d* is wound, a left taking-up pulley 34L, a right taking-up pulley 34R, and a lift driving apparatus 37.

The four wires 31*a*, 31*b*, 31*c*, and 31*d* have trailing ends respectively coupled to the hanging portions 22*a*, 22*b*, 22*c*, and 22*d* disposed at four positions of the mount portion 20A.

The winding pulleys 32*a*, 32*b*, 32*c*, and 32*d* are rotatably attached to respective portions in the container 17A above the upper ends of the guide holes 174 in the left and right side wall boards in the container 17A. The auxiliary pulleys 33*a* and 33*b* are rotatably attached to the side wall board of the container 17A to allow the wires 31*a* and 31*b* to be wound therearound so that the wires 31*a* and 31*b* are intendedly routed between the winding pulleys 32*a* and 32*b* and the left taking-up pulley 34L.

The left taking-up pulley 34L is disposed on the bottom surface of the container 17A to take up the wires 31*a* and 31*b* disposed on the left. The right taking-up pulley 34R is disposed on the bottom surface of the container 17A to take up the wires 31*c* and 31*d* disposed on the right.

The lift driving apparatus 37 includes components including a motor and a gear mechanism and rotates in a direction switchable between forward and reverse directions. The lift driving apparatus 37 is disposed at a portion on a far side of the housing 10. The left taking-up pulley 34L and the right taking-up pulley 34R are attached to the lift driving apparatus 37. One end portion of a rotatable rotation shaft 35 is coupled to the bottom surface of the container 17A via a detachably connectable coupling mechanism 36.

The lift 30 drives the lift driving apparatus 37 to rotate by a predetermined amount in a desired direction to take up the wires 31*a*, 31*b*, 31*c*, and 31*d* to raise the mount portion 20A. The lift 30 also drives the lift driving apparatus 37 to rotate by a predetermined amount in the reverse direction to unwind the wires 31*a*, 31*b*, 31*c*, and 31*d* to lower the mount portion 20A.

The driving of the lift driving apparatus 37 is controlled using detection information from a height position sensor 71 that detects the uppermost position of the sheet-shaped media 9 stacked on the mount portion 20A. More specifically, the lift driving apparatus 37 stops driving upon obtaining information that the uppermost position of the sheet-shaped media 9 detected by the height position sensor 71 arrives at a predetermined height position. As illustrated in, for example, FIGS. 3 and 6, the height position sensor 71 is disposed, for example, to be capable of detecting the uppermost position (height position) of the sheet-shaped media 9 viewable through the cut recess 173*b* in the leading-end wall 173 of the container 17A.

Figure 6:
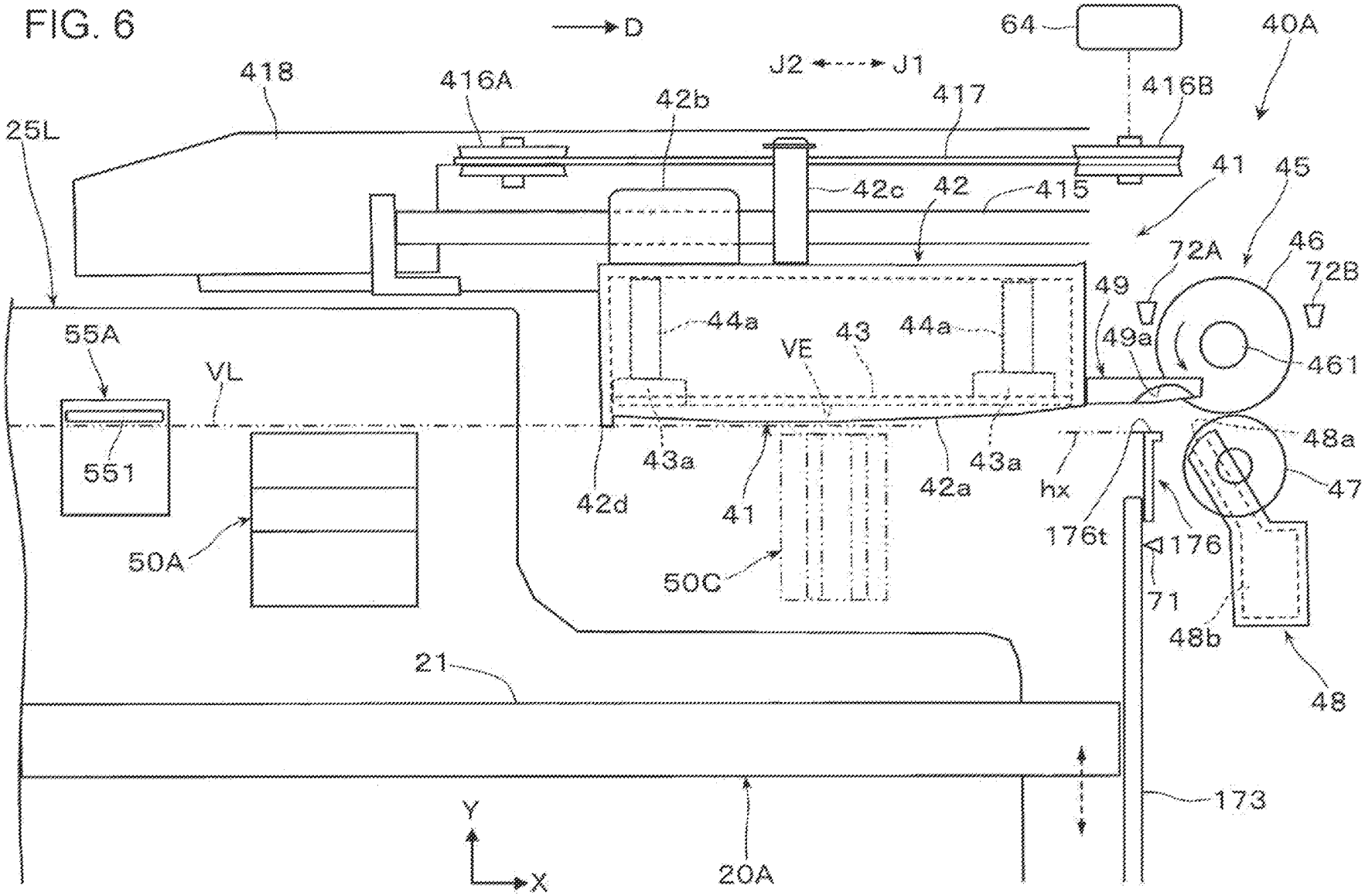
FIG. 6 is a schematic view of components of the feeder such as a suction portion and a transporter viewed from a side.

As illustrated in FIGS. 3, 4, and 6 and other drawings, in the mount portion 20A, the side walls 25L and 25R each include left and right air outlets 50 in the contact surface 251. The left and right air outlets 50 blow air to the left and right edge portions of upper ones of the sheet-shaped media 9 stacked on the mount portion 20A or 20B. The left and right air outlets 50 form part of left and right edge air blowers.

As illustrated in FIG. 4 and other drawings, the air outlets 50 include two air outlets 50A and 50B formed in the left side wall 25L and spaced apart from each other in the transportation direction D, and two air outlets 50C and 50D formed in the right side wall 25R and spaced apart from each other in the transportation direction D. The air outlets 50A and 50D are disposed to oppose each other in the transportation direction D. The left air outlets 50A and 50B each have, for example, an outlet through which air is actually blown out in the shape of a long hole extending in the horizontal direction. The right air outlets 50C and 50D each have, for example, an outlet through which air is actually blown out in the shape of a long hole extending in the vertical direction.

Figure 8:
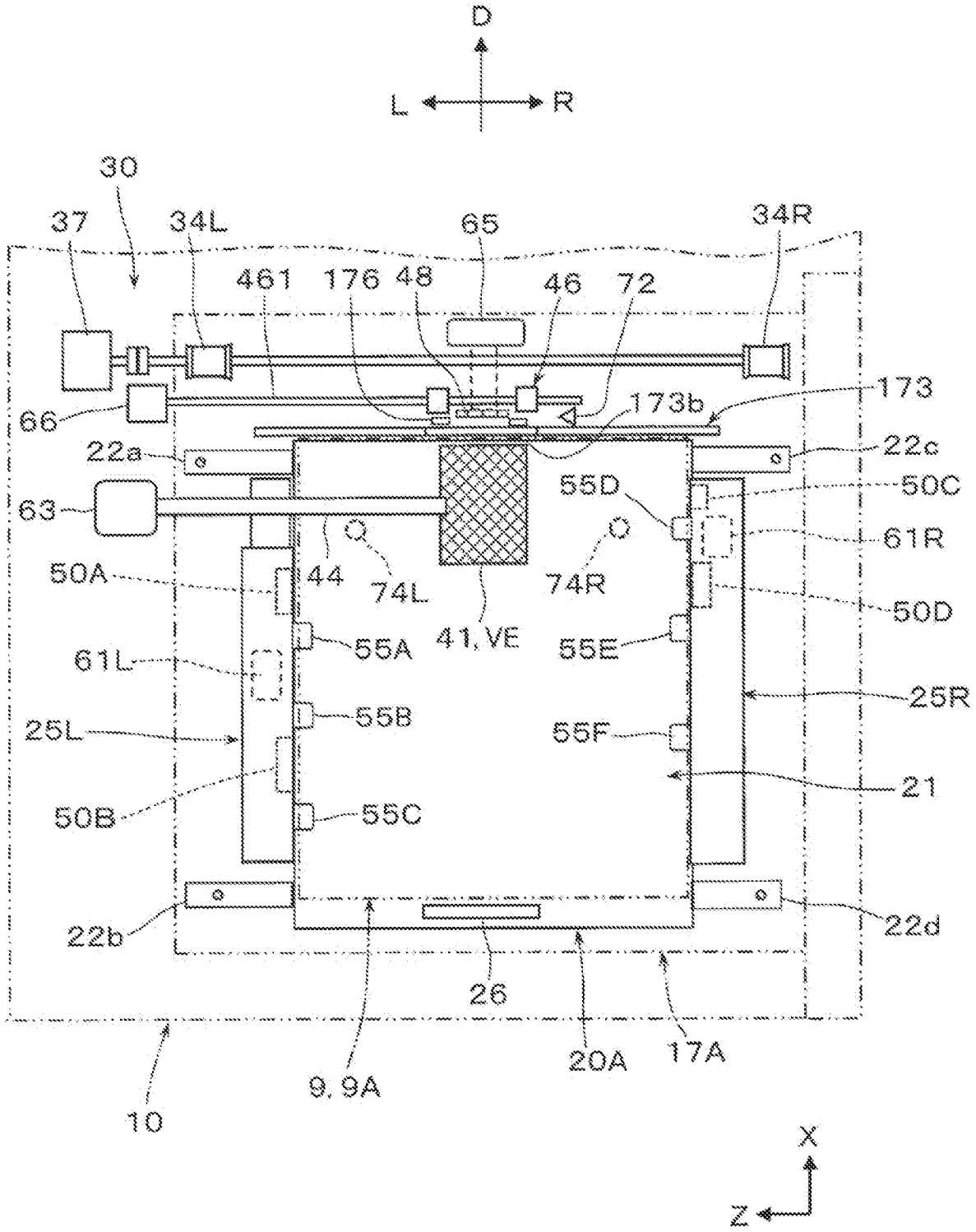
FIG. 8 is a schematic view of a structure of a driving system of the feeder viewed from above.

As illustrated in FIG. 8, the air outlets 50A and 50B are connected to a left edge air blowing device 61L via a blast duct not illustrated. The left edge air blowing device 61L forms a remaining portion of a left edge air blower disposed on the inner side of the left side wall 25L. The air outlets 50C and 50D are connected to a right edge air blowing device 61R via a blast duct not illustrated. The right edge air blowing device 61R forms a remaining portion of a right edge air blower disposed on the inner side of the right side wall 25R. Although not illustrated, open-close valves that open and close the flow paths in the blast ducts are disposed at the edge air blowing devices 61L and 61R.

The left and right edge air blowers blow air to the left and right edge portions of upper ones of the sheet-shaped media 9 stacked on the mount surface 21 through the air outlets 50A, 50B, 50C, and 50D when a suction portion 41, described below, of the dischargers 40A and 40B sucks the sheet-shaped media 9.

Figure 10:
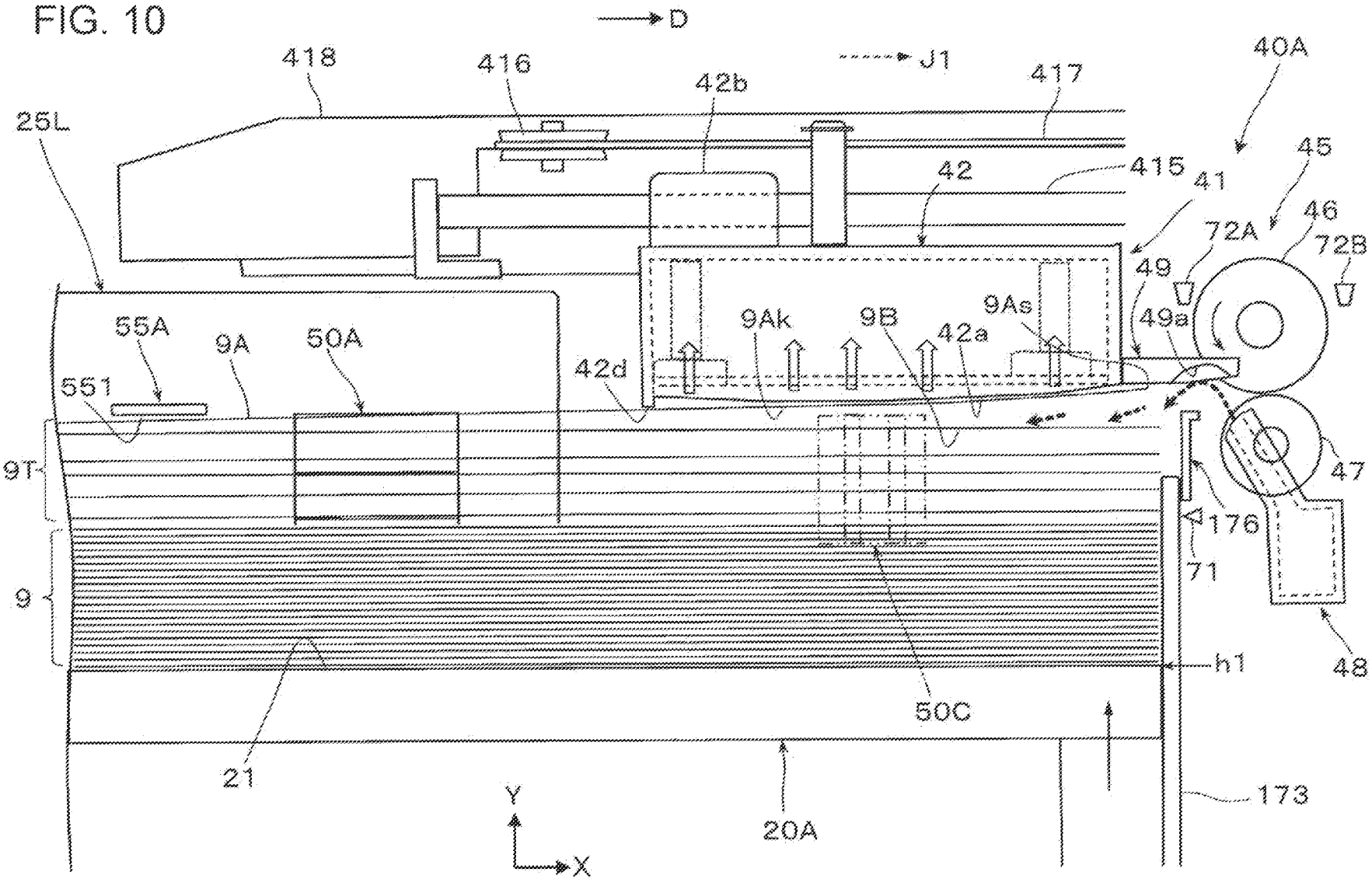
FIG. 10 is a schematic view of a feeder in an example state in a normal feeding operation.

Thus, multiple upper sheet-shaped media 9T at the mount portion 20A are raised to be spaced apart from each other in the vertical direction (refer to FIG. 10).

As illustrated in FIGS. 3 and 7 and other drawings, in the mount portion 20A, the side walls 25L and 25R each include multiple height limiters 55 on the contact surface 251. The height limiters 55 come into contact with the upper surfaces of the left and right edge portions of the sheet-shaped media 9 stacked on the mount portion 20A or 20B to limit the upper surfaces to a predetermined height.

As illustrated in FIGS. 3 and 4 and other drawings, the height limiters 55 in the left side wall 25L include one height limiter 55A disposed upstream from the air outlet 50A in the transportation direction D, and two height limiters 55B and 55C disposed on both sides of, that is, downstream and upstream from the air outlet 50B in the transportation direction D.

As illustrated in FIG. 4 and other drawings, the height limiters 55 in the right side wall 25R include one height limiter 55D disposed between the air outlet 50C and the air outlet 50D, and two height limiters 55E and 55F disposed downstream from the air outlet 50D in the transportation direction D.

As illustrated in FIG. 4 and other drawings, these height limiters 55A to 55F are formed from, for example, plate members protruding by a predetermined length from a predetermined height of the contact surfaces 251 of the side walls 25L and 25R over and above the mount surface 21 of the mount portion 20A or 20B.

As illustrated in, for example, FIGS. 6 and 7, contact surfaces 551 or lower surfaces of the height limiters 55A to 55F are located on the level the same as or higher than the level of a lowest portion 42*d* of a suction area VE, serving as a lowermost end of a frame 42 of the suction portion 41, described below. A two-dot chain line VL in FIG. 6 and other drawings is a virtual horizontal extension passing the lowest portion 42*d* of the frame 42.

During an operation of stacking the sheet-shaped media 9 on the mount surface 21 of the mount portion 20A or 20B (when the mount portion 20A or 20B is moved to the lowermost position), the height limiters 55A to 55F are, for example, retracted in the side walls 25L and 25R without protruding from the contact surfaces 251.

When, as described above, air is blown out through the air outlets 50 in the left and right edge air blowers to raise the multiple upper sheet-shaped media 9T, the height limiters 55A to 55F hold from above the left and right edge portions of the raised multiple upper sheet-shaped media 9T (actually, an uppermost sheet-shaped medium 9A).

Thus, over the mount portion 20A, the raised sheet-shaped media 9T are kept at a predetermined height from the mount surface 21 of the mount portion 20A.

As illustrated in FIGS. 4 to 6 and other drawings, the container 17A includes two stoppers 176 that prevent the raised sheet-shaped media 9T from accidentally moving in the transportation direction D to a position downstream from the recess 173*b* of the leading-end wall 173 in the transportation direction D. The stoppers 176 are, for example, plate-shaped members. The upper end of each stopper 176 is disposed inside the recess 173*b* of the leading-end wall 173 to protrude upward from the upper end of the leading-end wall 173 by a predetermined length.

As illustrated in FIGS. 2, 3, and 5 and other drawings, the dischargers 40A and 40B each include the suction portion 41, a transporter 45, a tip-end air blower, and a guide member, not illustrated. The suction portion 41 sucks the uppermost one of the sheet-shaped media 9 stacked on the mount portion 20A or 20B to carry the uppermost sheet-shaped medium 9A. The transporter 45 transports the sheet-shaped medium 9A sucked and transported by the suction portion 41. The tip-end air blower blows air to below the uppermost sheet-shaped medium 9A sucked by the suction portion 41. The guide member forms a first transport path Rh1, described below.

As illustrated in FIGS. 3 to 8 and other drawings, the suction portion 41 is disposed to oppose the mount surface 21 of the mount portion 20A or 20B at the downstream end portion of the container 17A or 17B in the transportation direction D and at an upper portion inward from the leading-end wall 173.

The suction portion 41 is formed as a suction head that includes a hollow cubic frame 42 with a lower surface open, a suction plate 43 including multiple inlet ports 43*a* arranged in a predetermined pattern, and multiple branched intake tubes 44*a* respectively connected to the multiple inlet ports 43*a*. The suction plate 43 is disposed slightly above and inward from the lower opening of the frame 42. The suction head is connected to a suction duct or pipe 44 connected to the multiple branched intake tubes 44*a*, and to a suction driving device 63 that sucks air through the suction duct or pipe 44.

This suction portion 41 operates the suction driving device 63 to cause suction force on the suction plate 43 of the suction head to suck the sheet-shaped medium 9 while bringing the sheet-shaped medium 9 into contact with a lowest portion 42*a* of the frame 42.

Thus, as illustrated in FIGS. 4 and 5, the suction portion 41 has a rectangular surface area surrounded by the lower side 42*a* of the frame 42 serving as a suction area VE. The suction area VE of the suction portion 41 according to the present exemplary embodiment has an area approximately opposing a portion of the mount surface 21 of each of the mount portions 20A and 20B located near the downstream end in the transportation direction D and substantially the center portion in the left and right directions L and R crossing the transportation direction D.

As illustrated in FIGS. 5, 6, and 7 and other drawings, the suction portion 41 is disposed upstream from the transporter 45 in the transportation direction D to move forward and rearward in a direction indicated with a broken double-pointed arrow toward the directions J1 and J2 parallel to the transportation direction D.

The suction portion 41 allows support portions 42*b* at upper portions of the frame 42 to be movably attached to two guide rails 415 disposed above the support portions 42*b* in parallel with the transportation direction D. The guide rails 415 are disposed on a support frame 418 fixed to an internal frame 19, or part of the housing 10.

The suction portion 41 has connection portions 42*c* at upper portions of the frame 42 fixed to part of a movable belt 417 wound around a pair of pulleys 416A and 416B above the guide rails 415. The pair of pulleys 416A and 416B are spaced apart from each other on the upstream and downstream sides in the transportation direction D. The movable belt 417 drives the suction portion 41 by a predetermined distance in a predetermined direction. As illustrated in FIG. 6, the pulley 416B is driven to rotate in a predetermined direction upon receipt of forward and reverse rotation power from a forward-rearward driving device 64 including, for example, a motor and a transmission.

During sucking the sheet-shaped medium 9, the suction portion 41 is stopped at a position (suction position) where the suction area VE faces the mount surface 21 of the mount portion 20A.

Subsequently, after finishing the suction, the suction portion 41 operates the forward-rearward driving device 64 to move the movable belt 417 to move forward toward the transporter 45 to a position (delivery position) where the transportation leading end 9*s* of the sucked uppermost sheet-shaped medium 9A is passed to the transporter 45. Subsequently, after finishing the delivery, the suction portion 41 operates the forward-rearward driving device 64 to move the movable belt 417 to move rearward from the delivery position to the suction position.

The transporter 45 is disposed outward from and downstream from the leading-end wall 173 of the container 17A or 17B in the transportation direction D, and downstream from the suction portion 41 in the transportation direction D.

As illustrated in FIGS. 5 and 6, the transporter 45 includes, for example, pairs of transport rollers, and a transport guide member not illustrated. Each pair of transport rollers include a driving transport roller 46 and a driven transport roller 47. The driving transport roller 46 includes a rotation shaft 461 and allows multiple transport rollers attached to the rotation shaft 461. The driven transport roller 47 is driven to rotate by coming into contact with a lower portion of the driving transport roller 46. The transport guide member defines a passage space of the first transport path Rh1.

As shown in FIG. 5, when viewed from the upstream side in the transportation direction D, the transport roller pairs each including the driving transport roller 46 and the driven transport roller 47 are disposed to be within a range, in the lateral direction, of the recess 173*b* of the leading-end wall 173.

As illustrated in FIG. 8, each driving transport roller 46 is driven to rotate in a direction of arrow (refer to FIG. 6) during a discharging operation with rotation power transmitted to the rotation shaft 461 from a discharging driving apparatus 66 including, for example, a motor or a gear transmission mechanism.

An introduction guide member 452 illustrated in FIG. 5 guides the transportation leading end 9*s* of each of the sheet-shaped media 9 sucked and transported by the suction portion 41 into a portion between rollers of the transporter 45 (contact portions each between the driving transport roller 46 and the driven transport roller 47).

The transporter 45 starts rotating upon receipt of detection information from a front position sensor 72A that detects passage of the transportation leading end 9*s* of the sheet-shaped medium 9 sucked by the suction portion 41 and on the way to be transported to the transporter 45. The transporter 45 stops rotating upon receipt of detection information from a rear position sensor 72B that detects passage of the transportation trailing end of the sheet-shaped medium 9 fed from the transporter 45. Instead, the transporter 45 may keep rotating during the feeding operation of the sheet-shaped media 9.

As illustrated in FIG. 6 or 8, the front position sensor 72A is disposed closer to and upstream, in the transportation direction D, from the pairs of transport rollers each including the driving transport roller 46 and the driven transport roller 47. The rear position sensor 72B is disposed closer to and downstream, in the transportation direction D, from the pairs of transport rollers each including the driving transport roller 46 and the driven transport roller 47. The front position sensor 72A and the rear position sensor 72B are, for example, optical non-contact sensors.

As illustrated in FIGS. 4 to 6 and 8, the tip-end air blower includes an air nozzle 48 including an outlet port 48*a* through which air is blown out, and an air guide board 49 that guides the air blown out from the outlet port 48*a* in a predetermined direction.

The air nozzle 48 is disposed at a position downstream, in the transportation direction D, from the leading-end wall 173 and a transportation leading end 9As of the uppermost sheet-shaped medium 9A sucked by the suction portion 41. The air nozzle 48 is disposed to have its outlet port 48*a* facing the upstream side in the transportation direction D through a gap between the driving transport roller 46 and the driven transport roller 47, or each pair of transport rollers of the transporter 45 to blow air from the outlet port 48*a* obliquely upward with respect to the transportation direction D.

As illustrated in FIGS. 6 and 8, the air nozzle 48 has an airway 48*b*, continuous with the outlet port 48*a*, connected to a tip-end air blowing device 65 that feeds blowing air via a blast duct not illustrated.

As illustrated in FIG. 6, the air guide board 49 is a plate-shaped member having a lower surface with a concave guide recess 49*a* set back upward. As illustrated with a broken curved bold arrow in FIG. 10 by way of example, the guide recess 49*a* guides air blown out from the outlet port 48*a* of the air nozzle 48 to below the uppermost sheet-shaped medium 9A sucked by the suction portion 41. The air guide board 49 is attached to the downstream side portion of the frame 42 of the suction portion 41 in the transportation direction D. Thus, the air guide board 49 moves with forward or reverse movement of the suction portion 41.

The air nozzle 48 of the tip-end air blower starts and stops blowing air at predetermined timing, for example, after activation of the tip-end air blowing device 65 upon receipt of information of starting the suction operation of the suction portion 41.

As illustrated in FIGS. 2 and 3, the discharge portion 14 includes the first transport path Rh1, and a second transport path Rh2. Along the first transport path Rh1, the sheet-shaped media 9 are transported to the outside by the discharger 40A from the feed unit 12 on the upper side. Along the second transport path Rh2, the sheet-shaped media 9 are transported to the outside by the discharger 40B from the feed unit 13 on the lower side.

The first transport path Rh1 and the second transport path Rh2 are discharge transport paths extending up to discharge rollers 142 at a discharge port 18 in a side portion 10B of the housing 10 while merging midway. The first transport path Rh1 and the second transport path Rh2 each include pairs of transport rollers, drawn with broken lines, and a transport guide member not illustrated.

Figure 9:
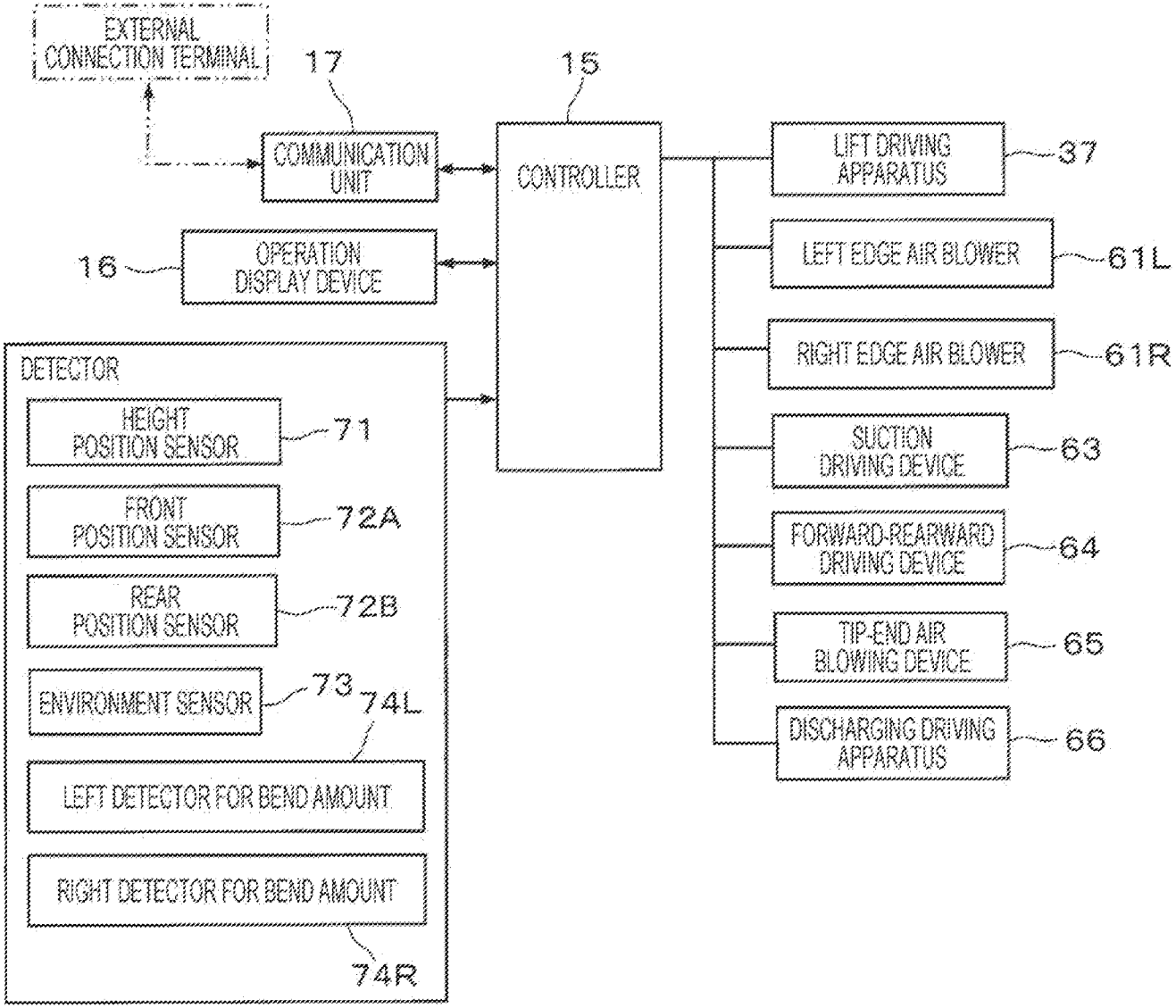
FIG. 9 is a schematic structure diagram of a control system of the feeder.

As illustrated in FIGS. 3 and 9, the feeder 1 includes a controller 15 that controls the feeder 1. The controller 15 includes, for example, a central processing unit (CPU), a read-only memory (ROM), a random access memory (RAM), and an input-output device. Instead of included in the feeder 1, the controller 15 may be included in an image forming system 100A that includes the feeder 1, or may be formed as part of a controller in the image forming system 100A.

The controller 15 is connected to, for example, an operation display device 16, a communication unit 17, and detectors including various sensors to obtain information used for control. The operation display device 16 includes, for example, an operation key and a liquid crystal panel that displays various information relating to, for example, inputs of operational settings or operation states. The communication unit 17 communicates with an external connection terminal used while being connected to, for example, the image forming system 100A. Examples of the detectors include the height position sensor 71, a front position sensor 72A, a rear position sensor 72B, and an environment sensor 73 that detects the environmental conditions such as the temperature or humidity in the housing 10 of the feeder 1.

The controller 15 is also connected to driving control circuits in the lift driving apparatus 37 in the lift 30, in left and right edge air blowing devices 61L and 61R in the left and right edge air blowers, in a suction driving device 63 and a forward-rearward driving device 64 in the suction portion 41, in the tip-end air blowing device 65 in the tip-end air blower, and in the discharging driving apparatus 66 in the transporter 45 to control these components.

The controller 15 performs calculation in accordance with various programs or data prestored in a read-only memory while the central processing unit captures input setting information of the operation display device 16 or various detection information from the detectors to operate a control target to transmit desired control signals.

The controller 15 also performs transportation auxiliary control, described below.

Operation of Feeding Sheet-Shaped Media

The operation of the sheet-shaped-medium feeder 1 feeding the sheet-shaped media 9 will be described now.

When the controller 15 receives a command of the feeding operation from an external connection terminal or the image forming system 100A, the feeder 1 confirms that the predetermined sheet-shaped media 9 are accommodated in the feed units 12 and 13, and then performs a series of the feeding operation. Here, the feeding operation will be described using the feed unit 12 on the upper side as an example.

Firstly, in the feed unit 12 on the upper side, the lift 30 starts raising the mount portion 20A. Thus, as illustrated in FIG. 10 by way of example, the mount portion 20A in the container 17A is raised until the uppermost one of the sheet-shaped media 9 stacked on the mount surface 21 of the mount portion 20A arrives at a predetermined ready-to-feed height with reference to the detection information from the height position sensor 71. Here, the mount portion 20A stops after the mount surface 21 is raised to a height position h1 corresponding to the ready-to-feed height.

Subsequently, after the mount portion 20A is completely raised to the ready-to-feed height, the left and right edge air blowing devices 61L and 61R in the left and right edge air blowers in the left and right side walls 25L and 25R are activated to start raising the sheet-shaped media 9, and the suction driving device 63 in the suction portion 41 in the discharger 40A is activated to start the sucking operation.

Here, on the mount portion 20A, air is blown at a predetermined flow rate through the air outlets 50A, 50B, 50C, and 50D in the left and right side walls 25L and 25R against the left and right edge portions of the upper sheet-shaped media 9T of the sheet-shaped media 9 stacked on the mount surface 21. Thus, as illustrated in FIG. 10 by way of example, the upper sheet-shaped media 9T are raised upward with air flowing in through the left and right edge portions to be vertically separated from each other.

Here, the upper surfaces of the left and right edge portions of the uppermost sheet-shaped medium 9A of the multiple raised sheet-shaped media 9T are prevented from being raised further while coming into contact with the contact surfaces 551 of the height limiters 55A to 55F, and have their height restricted at the height substantially the same as the height of the lowest portion 42*d* in the suction area VE.

Here, over the mount portion 20A, predetermined suction force (solid-white arrow) is caused at a suction plate 43 of the suction portion 41 that is stationary in the suction position where the suction operation is performed.

Thus, as illustrated in FIG. 10 by way of example, a leading-end portion 9Ak, in the transportation direction D, of the uppermost sheet-shaped medium 9A in the multiple raised sheet-shaped media 9T is sucked by the suction area VE having a negative pressure and surrounded by the lower end of the frame 42 in the suction portion 41.

The uppermost sheet-shaped medium 9A here is sucked after being slightly raised toward the suction portion 41. Thus, as illustrated in FIG. 10, the uppermost sheet-shaped medium 9A has a gap between itself and a second uppermost sheet-shaped medium 9B below.

The transportation leading end 9As of the sucked uppermost sheet-shaped medium 9A does not face the suction area VE, and is thus left free while being located close to a mount base of the lower surface of the air guide board 49 attached to the frame 42 at a position out of and downstream from the suction area VE in the transportation direction D.

Subsequently, after the uppermost sheet-shaped medium 9A is completely sucked by the suction portion 41, the tip-end air blowing device 65 in the tip-end air blower is activated to start separating the sucked uppermost sheet-shaped medium 9A from the other sheet-shaped media 9, and the forward-rearward driving device 64 in the suction portion 41 is activated to start moving forward toward the transporter 45 of the suction portion 41.

Here, in the tip-end air blower, as illustrated with broken bold arrows in FIG. 10 by way of example, predetermined air is blown from the outlet port 48*a* of the air nozzle 48 obliquely upward toward the upstream side in the transportation direction D, and the air is guided by the guide recess 49*a* of the air guide board 49 to be fed toward the space below the uppermost sheet-shaped medium 9A sucked by the suction portion 41.

The air is thus blown into the space between the sucked uppermost sheet-shaped medium 9A and the second uppermost sheet-shaped medium 9B. Thus, the second uppermost sheet-shaped medium 9B is spaced apart downward from the uppermost sheet-shaped medium 9A.

Here, the suction portion 41 of the discharger 40A moves forward from the suction position to the delivery position. Thus, the uppermost sheet-shaped medium 9A sucked by the suction portion 41 moves toward the transporter 45 on the downstream side in the transport direction D and is passed to the transporter 45. Specifically, the leading end 9As of the sheet-shaped medium 9A sucked and transported by the suction portion 41 is introduced into the contact portions each between the driving transport roller 46 and the driven transport roller 47, which are a pair of rollers in the transporter 45.

Here, when the front position sensor 72A detects passage of the leading end 9As of the to-be-delivered uppermost sheet-shaped medium 9A, in the transporter 45 in the discharger 40A, the discharging driving apparatus 66 is activated and starts discharging the sheet-shaped medium 9.

Thus, the uppermost sheet-shaped medium 9A passed from the suction portion 41 is held between each pair of the driving transport roller 46 and the driven transport roller 47 in the transporter 45 to be transported, discharged from the mount portion 20A and the container 17A, and fed to the first transport path Rh1.

Here, the discharged sheet-shaped medium 9A moves in the transportation direction D while having the left and right edge portions coming into contact with and being guided by the contact surfaces 251 of the left and right side walls 25L and 25R. Thus, the discharged sheet-shaped medium 9A is discharged while having a normal orientation without being inclined.

After the uppermost sheet-shaped medium 9A starts being discharged, the suction driving device 63 in the suction portion 41 stops operating to finish the suction operation.

When the rear position sensor 72B detects passage of the trailing end of the transported uppermost sheet-shaped medium 9A, the transporter 45 stops the operation of the discharging driving apparatus 66 to finish the discharging operation. When the rear position sensor 72B detects passage of the trailing end of the transported uppermost sheet-shaped medium 9A, the suction portion 41 moves rearward to be returned from the delivery position to the suction position.

Thus, after the uppermost sheet-shaped medium 9A is discharged from the feed unit 12 on the upper side through the discharge port 18 via the first transport path Rh1, the sheet-shaped medium 9A is fed to the image forming apparatus 120A (the first introduction transport path Rt1 of the image forming apparatus 120A), serving as an example of a destination.

In the feeder 1, in substantially the same manner as in the feeding operation of the feed unit 12 on the upper side, the sheet-shaped media 9 stacked on the mount portion 20B are also discharged from the feed unit 13 on the lower side through the discharge port 18 via the second transport path Rh2, and then the sheet-shaped media 9 are fed to the destination.

In the image forming system 100A, when the sheet-shaped media 9 are fed from the feeder 1 to the image forming apparatus 120A serving as an example of the processing device 120, images are formed on the sheet-shaped media 9.

Figure 11:
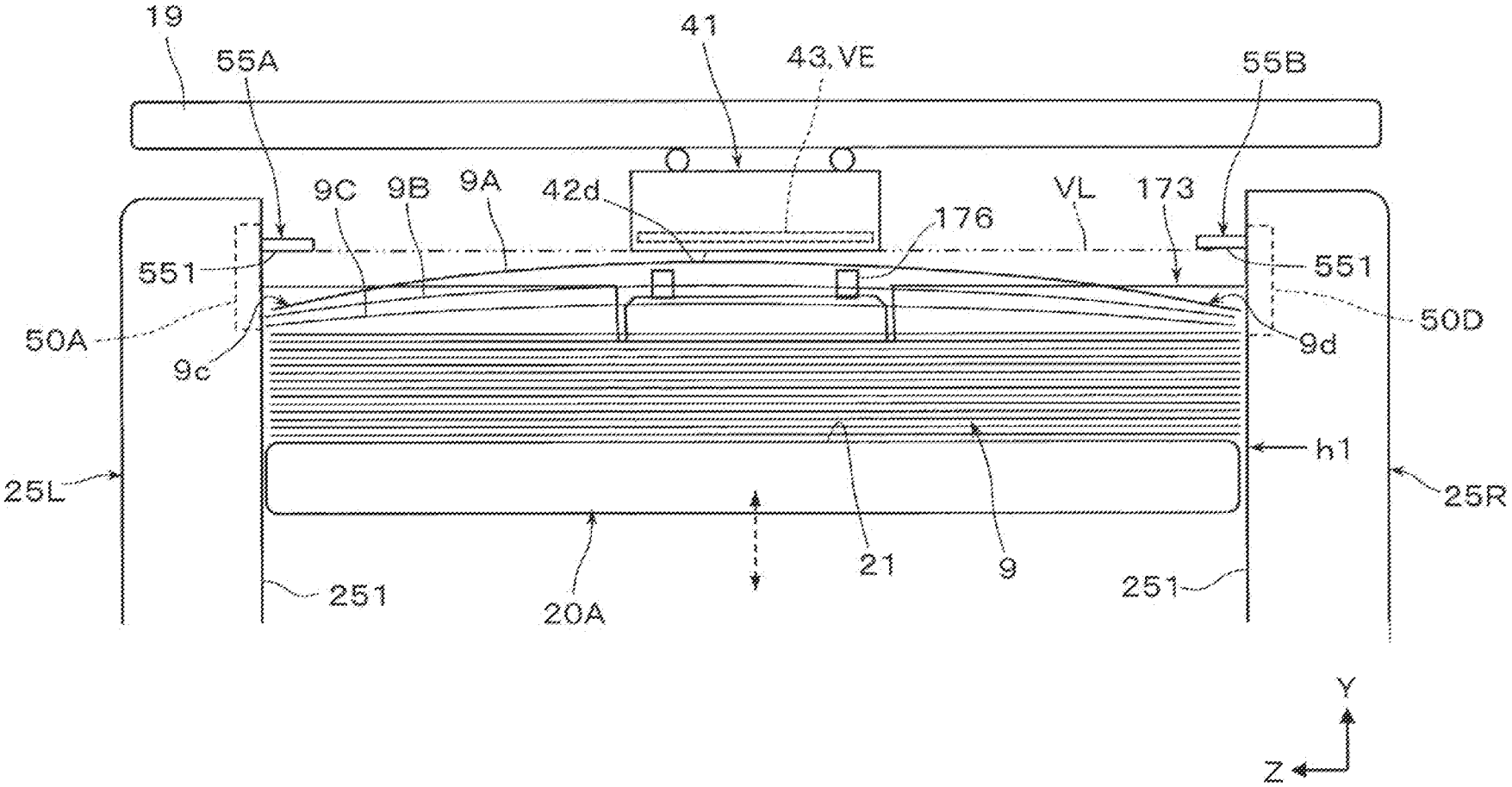
FIG. 11 is a schematic view of an example state in an operation of feeding a sheet-shaped medium with downwardly bent left and right edge portions.
Figure 17:
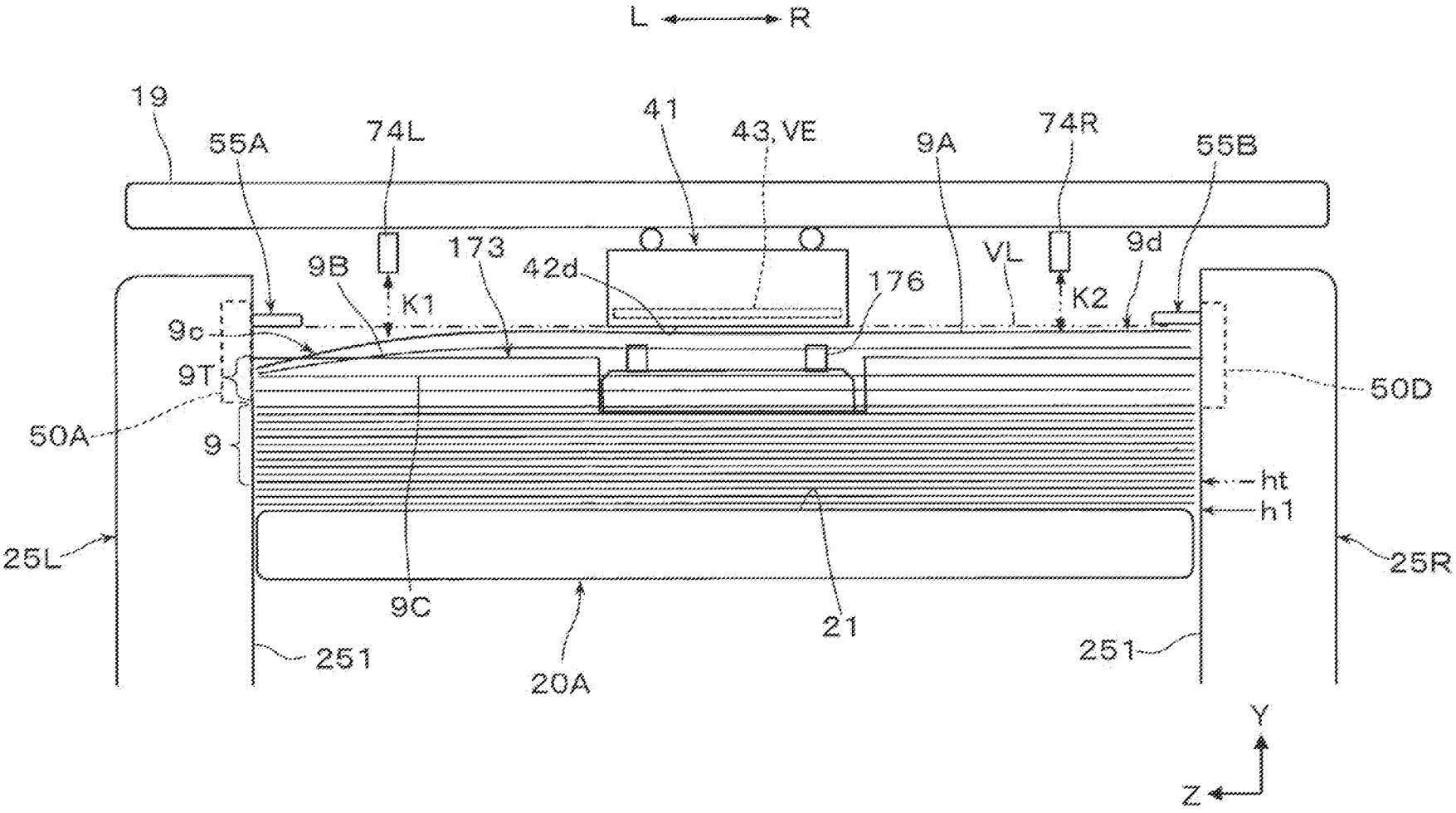
FIG. 17 is a schematic view of another example state of the first operation.
Figure 19:
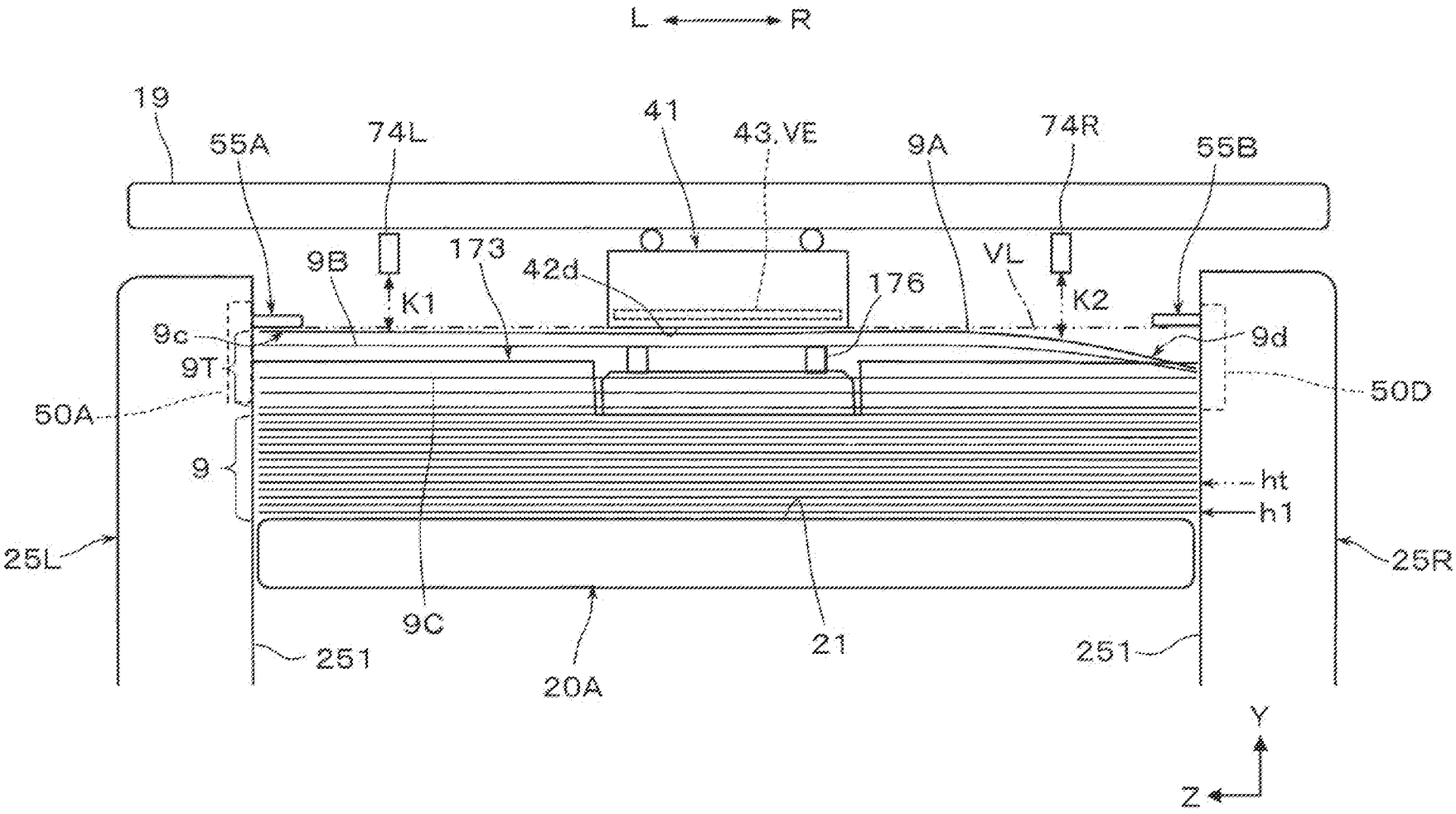
FIG. 19 is a schematic view of another example state of the first operation.

However, as illustrated in FIGS. 11, 17, and 19 by way of example, in the feeder 1 where either one or both of the left and right edge portions 9*c* and 9*d*, during transportation, of the sheet-shaped media 9 stacked on the mount surface 21 of the mount portion 20A are bent downward to be displaced a predetermined amount or more from the center portion, air fails to smoothly flow between the left and right edge portions 9*c* and 9*d* of the multiple upper sheet-shaped media 9T to raise these sheet-shaped media 9T with air flow from the air outlets 50 of the edge air blowers.

More specifically, the bent downward left and right edge portions 9*c* and 9*d* or left or right edge portions 9*c* or 9*d* of the sheet-shaped media 9 block passage of air blown from the air outlets 50. Thus, the air fails to be dispersed to flow smoothly between the left and right edge portions of the multiple upper sheet-shaped media 9T, unlike in the normal state.

Thus, the uppermost sheet-shaped medium 9A fails to be fully separated from the second uppermost and following sheet-shaped media 9B and 9C, and thus a transport error such as an overlap transport where multiple sheet-shaped media 9 including, for example, the uppermost sheet-shaped medium 9A and the second uppermost sheet-shaped medium 9B are transported while being overlapped with each other.

Other possible transport errors include a dog ear where a corner of the uppermost sheet-shaped medium 9A is bent as a result of the curved portion of the uppermost sheet-shaped medium 9A coming into contact with a surrounding component such as the introduction guide member 452 with an excessive pressure, and a paper jam where a sheet is jammed while being discharged and fails to be discharged.

Another Structure of Feeder

As illustrated in FIGS. 5, 7, 12, and 13 and other drawings, the feeder 1 includes left and right detectors 74L and 74R that individually detect the amount by which the left and right edge portions 9*c* and 9*d* are bent downward while the uppermost sheet-shaped medium 9A stacked on the mount surface 21 of the mount portion 20A is transported. When one or both of the left and right detectors 74L and 74R detect that the left and right edge portions 9*c* and 9*d* are bent downward by an amount reaching or exceeding a predetermined amount, a first operation for reducing a height difference Δh between portions of the uppermost sheet-shaped medium 9A in the transportation width direction is to be performed.

Figure 12:
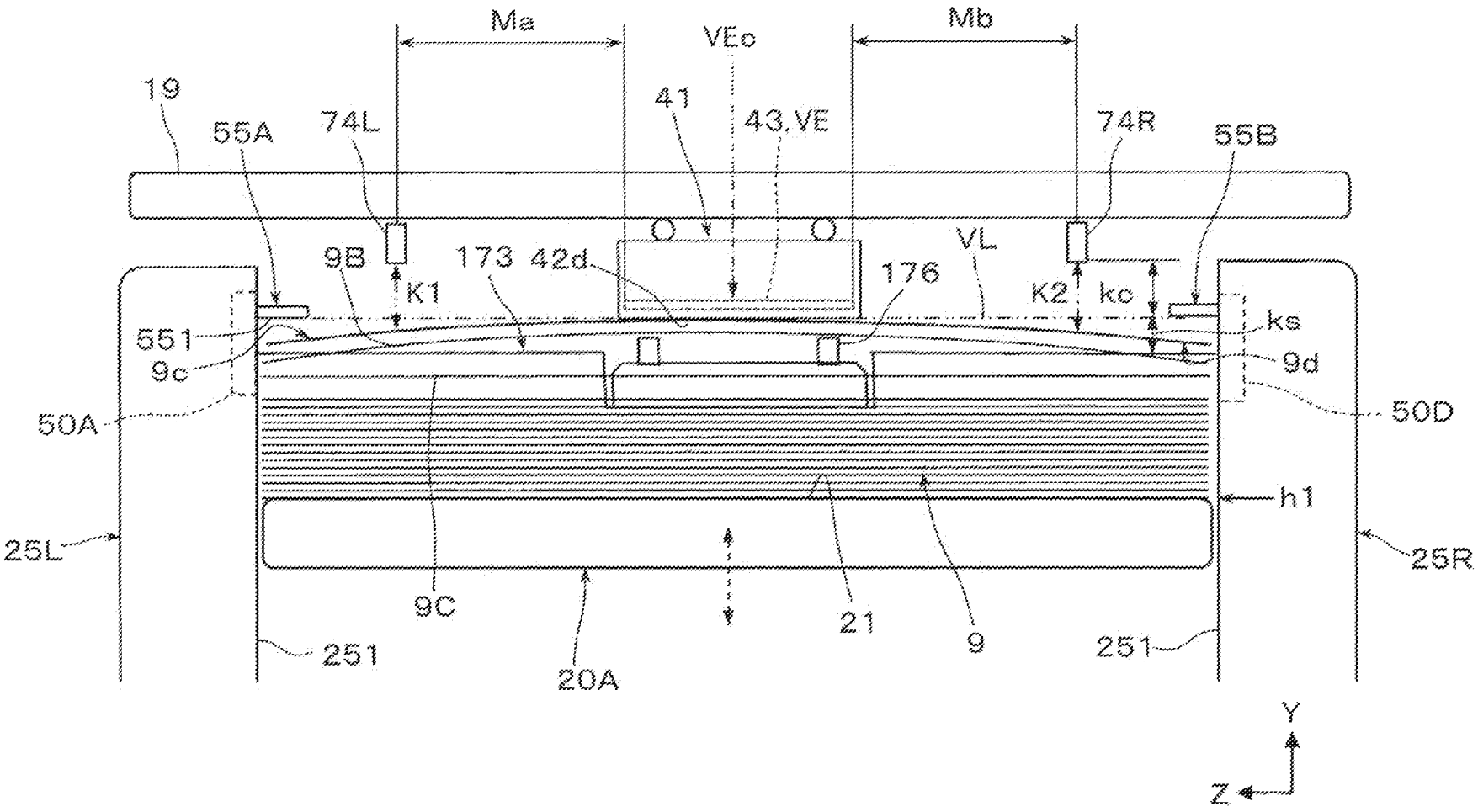
FIG. 12 is a schematic view of a portion of the feeder such as a left and right detectors.

As illustrated in FIGS. 7, 8, and 12 and other drawings, the left and right detectors 74L and 74R are disposed in the housing 10 above the mount surface 21 on the left and right sides of the suction portion 41 and at the same position in the transportation direction D. The detector 74L and the detector 74R are disposed to have their detection surfaces (center portions) spaced by substantially the same spacing distance N from a downstream end 21*s* of the mount surface 21 in the transportation direction D.

Figure 13:
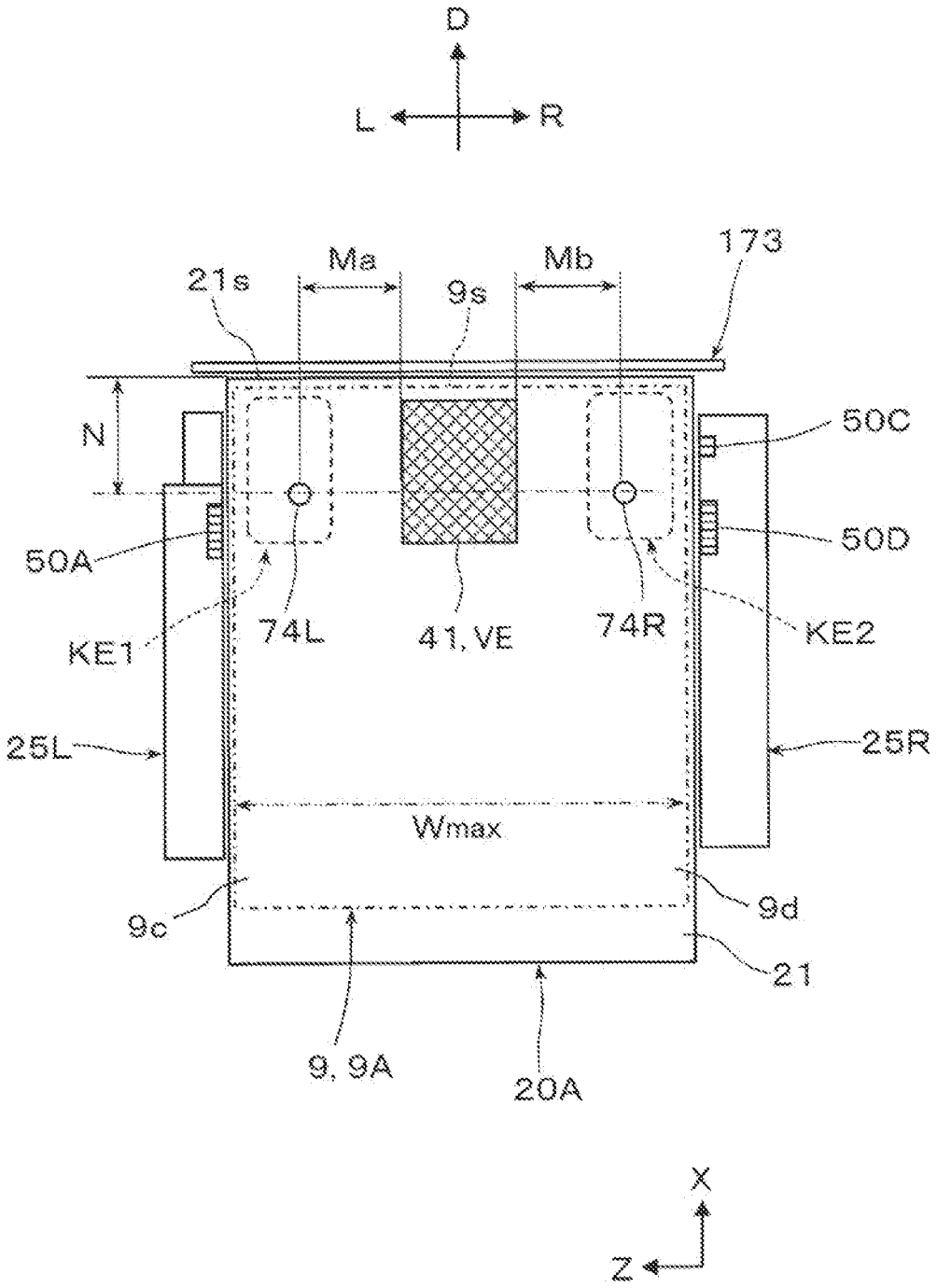
FIG. 13 is a schematic view of a portion of the feeder including left and right detectors viewed from above.

As illustrated in FIGS. 12 and 13 and other drawings, the detectors 74L and 74R according to the present embodiment have their detection surfaces symmetrically disposed on the left and right sides of the suction area VE of the suction portion 41. Thus, a spacing distance Ma between the left edge portion of the suction area VE and the suction portion 41 on the detection surface of the detector 74L and a spacing distance Mb between the right edge portion of suction area VE and the suction portion 41 on the detection surface of the detector 74R are substantially the same. FIG. 12 illustrates a center portion VEc of the suction area VE in the suction portion 41 in the lateral direction.

As examples of the left and right detectors 74L and 74R, left and right amount-of-bend detection sensors formed from optical distance sensors capable of measuring a distance K from the upper surface of the sheet-shaped medium 9 are used. The left detector 74L measures a distance K1 from the upper surface of the left edge portion of the sheet-shaped medium 9. The right detector 74R measures a distance K2 from the upper surface of the right edge portion of the sheet-shaped medium 9.

Preferably, the detectors 74L and 74R are capable of detection in, for example, part or all of areas KE1 and KE2 surrounded by broken lines in FIG. 13. The areas KE1 and KE2 are left and right areas of the suction area VE in the suction portion 41 within which the left and right bent edge portions of the sheet-shaped medium 9 having a transported width W of a maximum width Wmax are detectable.

As illustrated in FIG. 9, the left and right detectors 74L and 74R are connected to the controller 15 to transmit detection information to the controller 15.

The detectors 74L and 74R perform detection in the operation of feeding the sheet-shaped media 9 after the uppermost sheet-shaped medium 9A is sucked by the suction portion 41. During this detection, air is blown from the air outlets 50 of the edge air blowers.

The detectors 74L and 74R also measure the actual distances K1 and K2 from the detection surfaces to the left and right edge portions of the uppermost sheet-shaped medium 9A.

However, as an example of the detection information from the detectors 74L or 74R, a value (K1-kc or K2-kc) obtained by subtracting a distance kc (refer to FIG. 12) from each detection surface to a reference height (virtual line) VL, from the actually measured distance K1 or K2 is used. The reference height (virtual line) VL is the height of the lowest portion 42*a* of the suction portion 41 used as a reference. The detection information here is obtained as difference information (bend amount ΔK or shift amount) between the height of the left and right edge portions of the sucked uppermost sheet-shaped medium 9A and a height (height of the sucked portion) of the center portion (sucked portion) of the sheet-shaped medium 9A.

When obtaining the detection information from the detectors 74L and 74R, the controller 15 determines whether a bend amount ΔK serving as the detection information is greater than or equal to a predetermined threshold Kd as a determination step of transportation auxiliary control involving the first operation.

The threshold Kd is set as appropriate in consideration of the state in the feeding operation where transport errors or failures are more likely to occur. The threshold Kd may be set to, for example, a value smaller than a height difference ks (refer to FIG. 12) between the reference height VL or the height of the lowest portion 42*d* of the suction portion 41 and an upper end of the leading-end wall 173 (or an upper end of each stopper 176). The threshold Kd may be set within a range of, for example, greater than or equal to 5 mm and smaller than or equal to 10 mm.

Figure 16A:
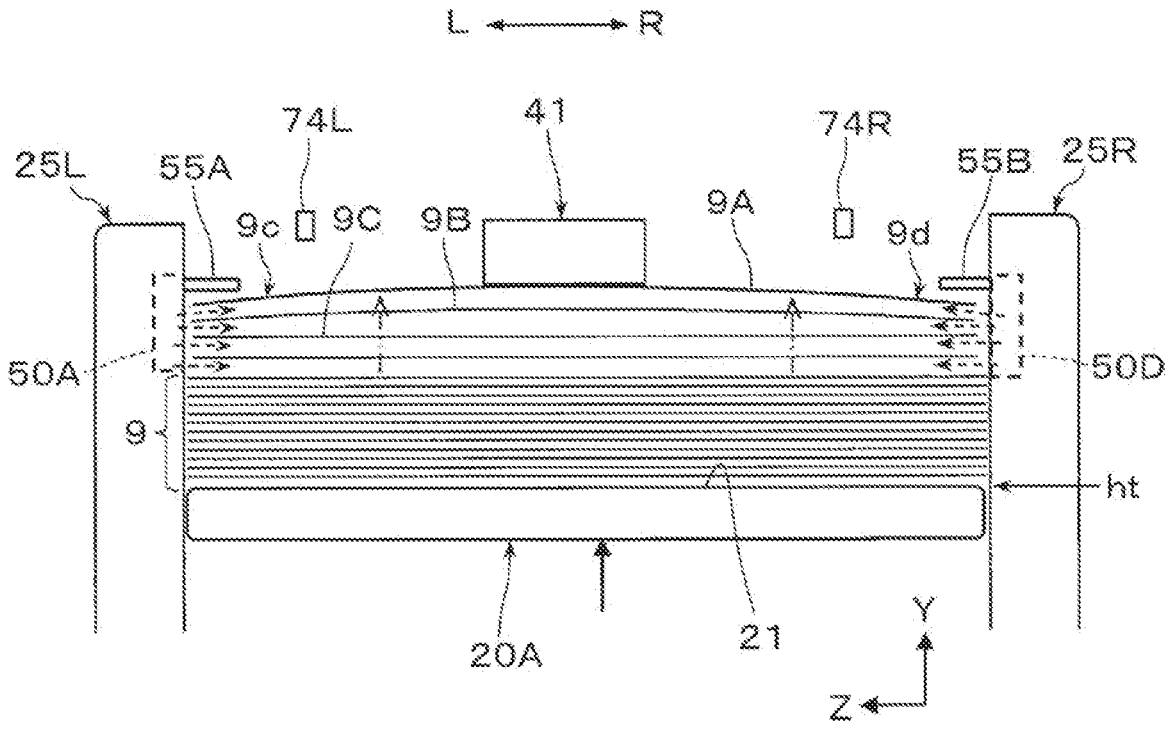
FIG. 16A is a schematic view of an example state change of the first operation in FIG. 15.
Figure 16B:
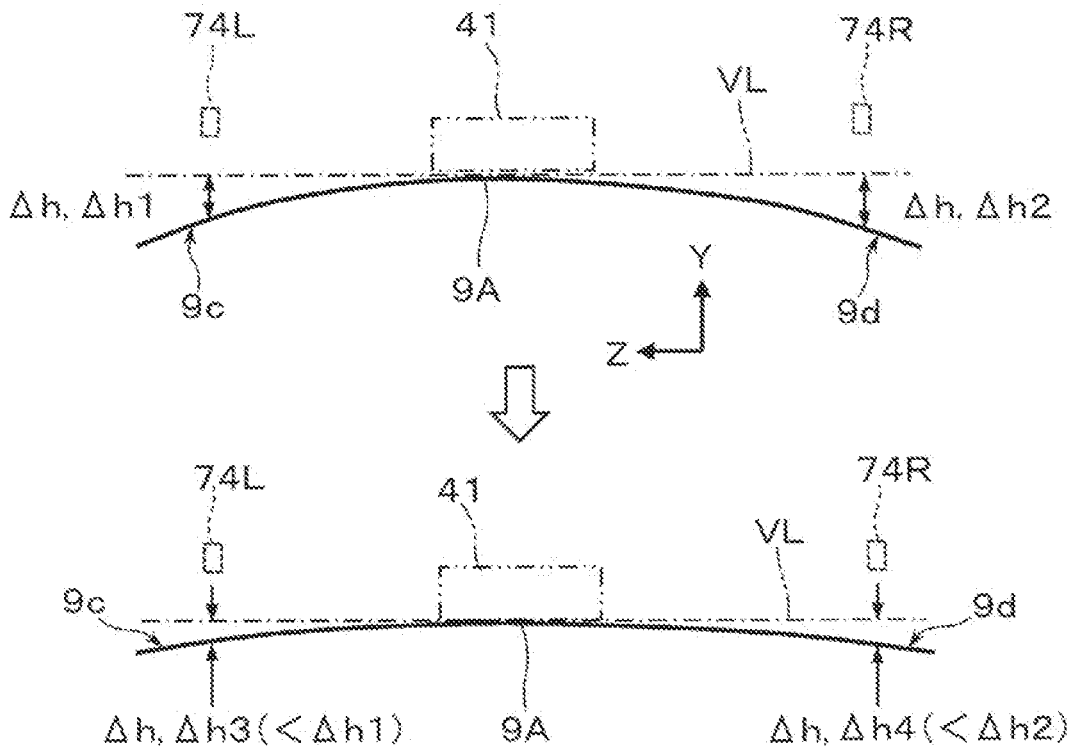
FIG. 16B is a schematic view of an example state change of a sheet-shaped medium before and after the first operation is performed.

As illustrated in FIG. 16B, the first operation may be any operation of reducing the height difference Δh between portions of the uppermost sheet-shaped medium 9A in the transportation width direction (direction indicated with a double-pointed arrow toward the directions J1 and J2) having one of or both of the left and right edge portions 9*c* and 9*d* bent downward by a predetermined amount or more. In the exemplary embodiment, the following operation is employed.

Figure 14:
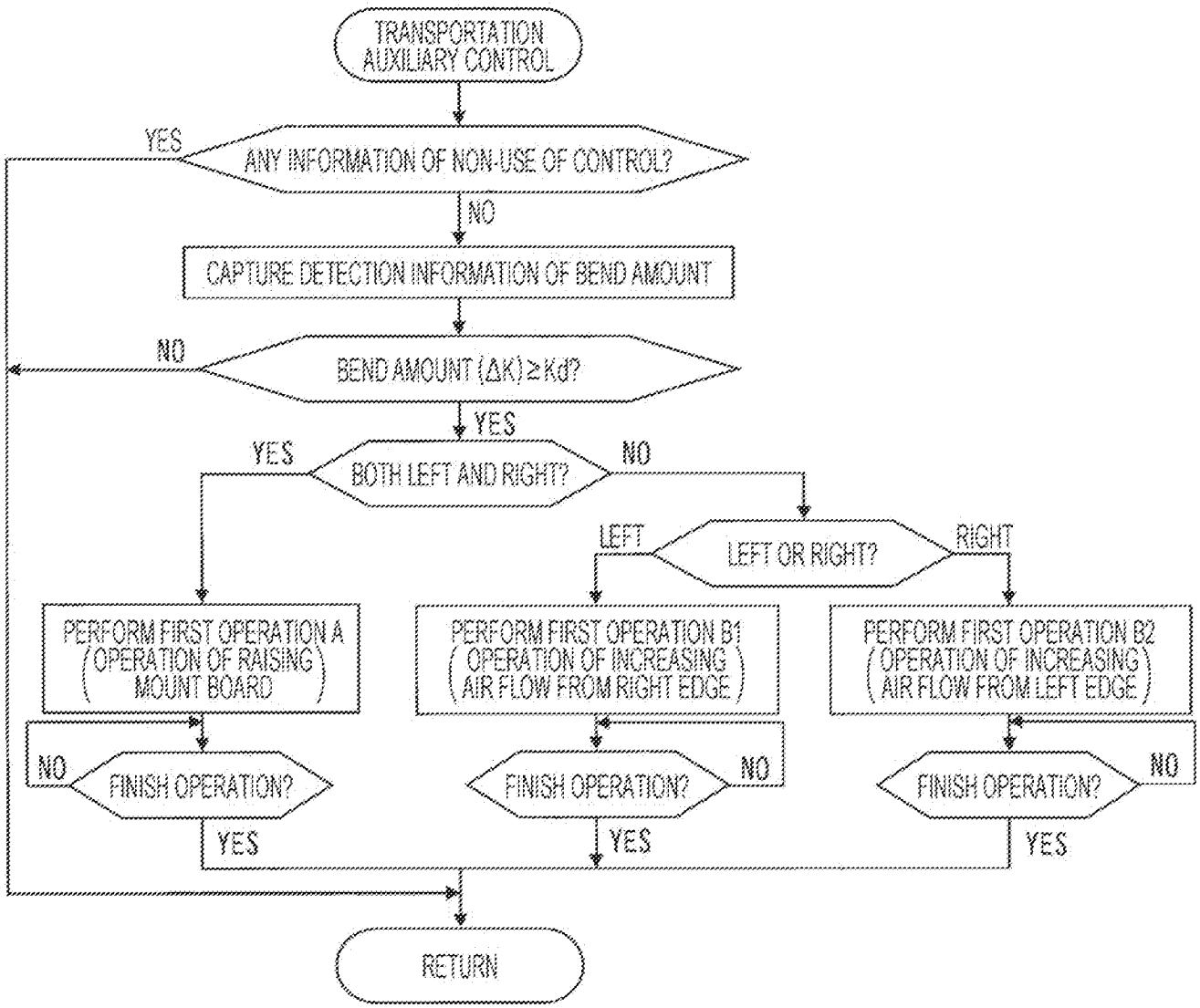
FIG. 14 is a flowchart of transportation auxiliary control of a feeder including a first operation.

Specifically, as illustrated in FIG. 12 or 14, an example of the first operation employed here is an operation (first operation A) of raising the mount portion 20A to a position higher than the current position when both the left and right detectors 74L and 74R detect that the downward bend amount ΔK is greater than or equal to a specific amount or a threshold Kd. As illustrated in FIGS. 14, 17, and 19 and other drawings, another example of the first operation employed here is an operation (first operation B) of, when one of the left and right detectors 74L and 74R detects that the downward bend amount ΔK is greater than or equal to the specific amount or the threshold Kd, increasing the air flow from the air outlets 50 on either the left or right edge air blower on the same side of the other one of the left and right detectors 74L and 74R.

Here, the current position of the mount portion 20A serving as an example of a mount board is a latest height position h1 (refer to FIG. 15) of the mount surface 21 when the mount portion 20A or 20B is raised to and stopped at a ready-to-suck position to perform the suction operation in the feeding operation. The ready-to-suck position is gradually raised with decrease of the stacked sheet-shaped media 9 through feeding, and is thus changed in accordance with the progress of the feeding operation.

The amount by which the mount portion 20A is raised from the current position is set to a raising value required for reducing both the left and right height differences Δh1 and Δh2 at the bend portions in the uppermost sheet-shaped medium 9A. The raising value may be set to, for example, a value greater than or equal to the threshold Kd.

The operation of raising the mount portion 20A or 20B is performed by operating the lift driving apparatus 37 in the lift 30 to raise the mount board by a desired amount.

Subsequently, the extent by which the air flow from the air outlets 50 of the left or right edge air blower on the other side is increased is set at an extent (flow rate or speed) of air required to reduce the left or right height difference Δh1 or Δh2 at the bent portion in the uppermost sheet-shaped medium 9A. Here, the flow rate at the air outlets 50 of the left or right edge air blower corresponding to the bent portion of the uppermost sheet-shaped medium 9A remains unchanged at the normal rate.

The value for increasing the air flow may be, for example, set to a value required for air to raise the downwardly bent portion. Here, naturally, the value is prevented from being increased to a flow rate with which the raised upper sheet-shaped media 9T including the uppermost sheet-shaped medium 9A may move irregularly.

The operation of decreasing the air flow from the edge air blower is performed by reducing the driving rate of the left and right edge air blowing devices 61L and 61R in the left and right edge air blowers or by reducing the degree of opening of the open-close valve.

The transportation auxiliary control to perform the first operation is performed when needed, and not performed when not needed.

Examples of information of non-use of the transportation auxiliary control include information of use of a relatively narrow sheet-shaped medium with a transportation width W not detectable by the left and right detectors 74L and 74R, and information of use of a preset specific type of sheet-shaped medium. The information of non-use of the transportation auxiliary control may be stored in advance in a storage such as ROM as part of control data in the feeder 1, or additionally stored later as needed.

Here, a relatively narrow sheet-shaped medium with the transportation width W is less likely to have downwardly bent left and right edge portions, and is less likely to require the transportation auxiliary control. Examples of a predetermined specific type of sheet-shaped medium include a medium such as an envelope. An envelope is more likely to be inclined to the left or right when mounted on the mount surface 21 regardless of the left or right edge portion, during transportation, not being bent. The medium with such characteristics is also less likely to require the transportation auxiliary control.

The first operation may be finished when arrived at a preset amount or the operation time. Instead, the operation may be finished when both the left and right detectors 74L and 74R are determined to no longer detect that the bend amount ΔK is greater than or equal to a constant amount of the threshold Kd after the first operation is performed.

The transportation auxiliary control involving the first operation is performed as one of control operations of the controller 15.

A program or data for performing the transportation auxiliary control is stored in advance in a read-only memory.

Transportation Auxiliary Control

When the feeder 1 capable of performing the transportation auxiliary control starts the operation of feeding the sheet-shaped media 9, as illustrated in FIG. 14, first, the controller 15 determines whether there is any information of non-use of the transportation auxiliary control.

When the controller 15 determines that there is information of non-use of the transportation auxiliary control, the feeder 1 determines that the transportation auxiliary control is not performed in the currently requested series of feeding operations. When the controller 15 determines that there is no information of non-use of the transportation auxiliary control, the feeder 1 performs the following information processing.

Subsequently, in the feeder 1, the controller 15 captures detection information of each of the bend amounts ΔK (K1-kc and K2-kc) detected by the left and right detectors 74L and 74R, and determines whether each bend amount ΔK is greater than or equal to the threshold Kd. As described above, the detectors 74L and 74R perform detection while the uppermost sheet-shaped medium 9A is sucked by the suction portion 41.

When each bend amount ΔK is determined to be smaller than the threshold Kd, the transportation auxiliary control is not required in the feeding operation, and not performed. When any of the bend amounts ΔK is determined to be greater than or equal to the threshold Kd, whether this detection information is from both the left and right detectors 74L and 74R is determined.

When the transportation auxiliary control is required, the transportation auxiliary control is performed on each operation of feeding one sheet-shaped medium 9.

When the controller 15 determines that detection information from both the left and right detectors 74L and 74R is greater than or equal to the threshold Kd, the feeder 1 performs the first operation A until the suction operation is finished.

The case where the detection information from both the detectors is determined as being greater than or equal to the threshold Kd corresponds to the case where, as illustrated in FIG. 12 by way of example, both left and right edge portions of at least the uppermost sheet-shaped medium 9A are bent downward a specific amount of more. The typical cause of the bend is downward curling, but is not limited to this.

The first operation A is an operation of raising the mount portion 20A or 20B to a position higher than the current position h1. Thus, the first operation A is performed by the controller 15 as a control of operating the lift driving apparatus 37 to raise the mount portion 20A or 20B until the mount surface 21 arrives at the predetermined height position ht (refer to FIG. 15).

Figure 15:
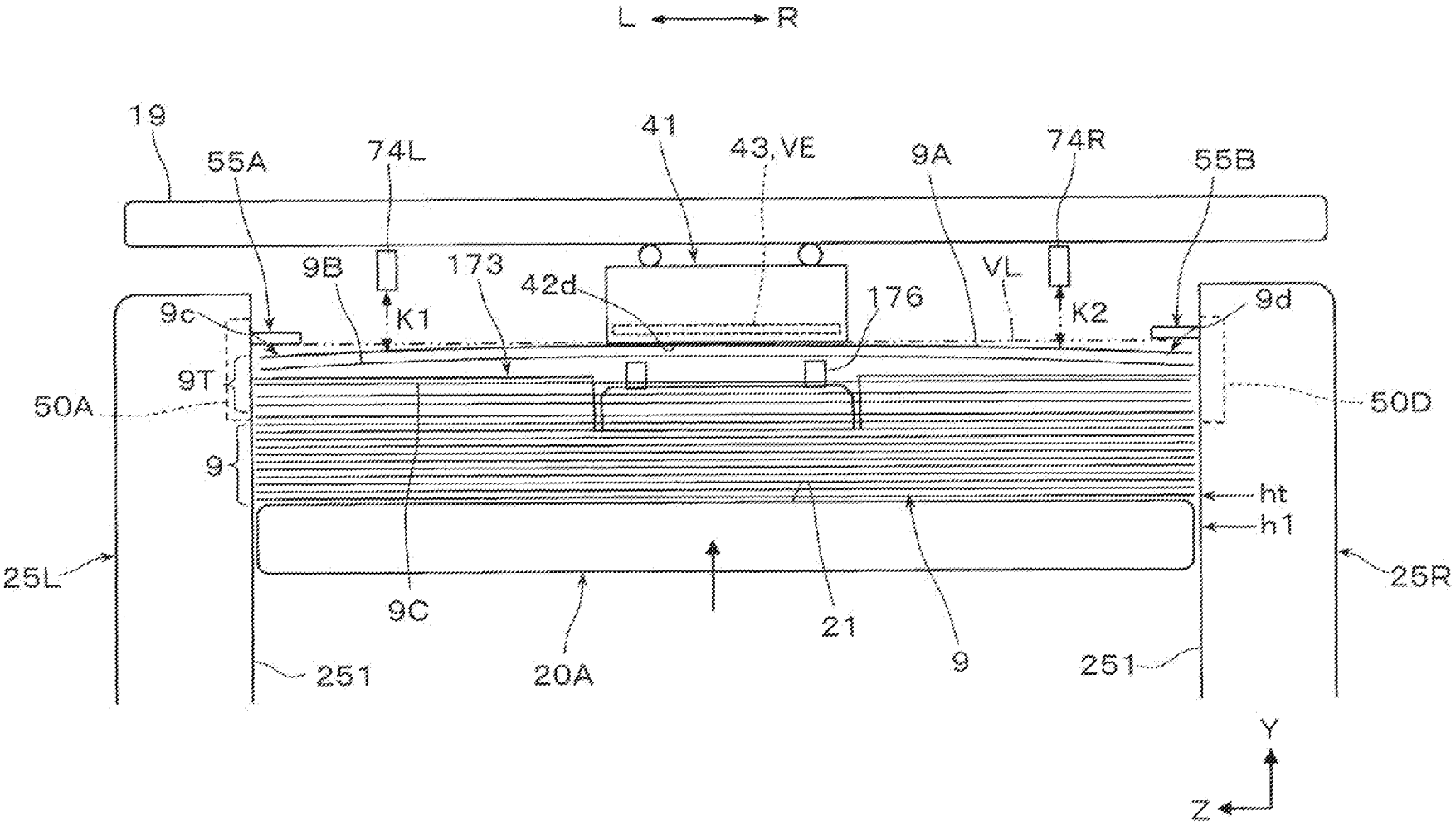
FIG. 15 is a schematic view of an example state in the first operation.

Thus, as illustrated in FIG. 15, in the feeder 1, the mount portion 20A is raised to and stopped at the predetermined height position ht while the uppermost sheet-shaped medium 9A is sucked by the suction portion 41.

Here, the height position ht where the mount portion 20A is stopped may be a predetermined height position (amount of movement) or a height position where the mount portion 20A is controlled to be stopped when the bend amounts ΔK detected by the left and right detectors 74L and 74R fall below the threshold Kd. In the structure where the mount portion 20A is stopped after being raised by a predetermined shift amount in the raising operation in the first operation A, the shift amount may be changed by, for example, a user.

In the feeder 1, the mount portion 20A moves toward the suction portion 41, and thus the sheet-shaped media 9 stacked on the mount surface 21 also moves toward the suction portion 41, and the stacked sheet-shaped media 9 push up the uppermost sheet-shaped medium 9A from the lower surface using the upper sheet-shaped media raised with air blown from the air outlets 50A and 50D of the edge air blowers interposed therebetween.

Here, the upper ones of the stacked sheet-shaped media 9 moving upward with the raising movement of the mount portion 20A move upward upon receiving air blown from, for example, the air outlets 50A and 50D of the edge air blowers. Thus, in cooperation with the sheet-shaped media 9T already raised, the left and right edge portions 9*c* and 9*d* of the uppermost sheet-shaped medium 9A are also pushed upward from the lower surface.

Thus, as illustrated in FIG. 16A, the uppermost sheet-shaped medium 9A is raised while having the downwardly bent left and right edge portions raised to reduce the height differences Δh in the width direction. More specifically, as illustrated in FIG. 16B, the left and right height differences Δh1 and Δh2 of the uppermost sheet-shaped medium 9A before the first operation A are changed to height differences Δh3 and Δh4 smaller than the height differences Δh1 and Δh2.

When the downwardly bent left and right edge portions of the uppermost sheet-shaped medium 9A are raised, the height differences Δh in the width direction are reduced. Thus, as illustrated in FIG. 16A with broken arrows by way of example, air blown from, for example, the air outlets 50A and 50D of the edge air blowers more smoothly flows between the uppermost sheet-shaped medium 9A and the second uppermost sheet-shaped medium 9B or between the left and right edge portions of the raised upper sheet-shaped media 9T. The intervention of air separates the media therebetween.

Here, the first operation A is stopped when the controller 15 determines that both the bend amounts ΔK detected by the left and right detectors 74L and 74R fall below the threshold Kd.

The feeder 1 finishes the first operation A with the above operation.

When the feeder 1 finishes the first operation A, the mount portion 20A or 20B stopped at the height position ht under the control of the controller 15 are lowered to be returned to the original height position h1. With the completion of the first operation A, the suction operation is also finished.

Subsequently, in the feeder 1, the suction portion 41 moves forward from the suction position to the delivery position, and air is blown from the air nozzle 48 in the tip-end air blower.

Here, as illustrated in FIG. 15 or 16A, the uppermost sheet-shaped medium 9A sucked by the suction portion 41 is separated from the second uppermost sheet-shaped medium 9B, and has the downwardly bent left and right edge portions raised.

Thus, the uppermost sheet-shaped medium 9A here is separated from the second uppermost sheet-shaped medium 9B with air blown from the air nozzle 48, and is thus prevented from being passed to the transporter 45 together with the second uppermost sheet-shaped medium 9B or prevented from being transported in an overlapped manner. The uppermost sheet-shaped medium 9A is prevented from having the left and right corners at the leading end accidentally colliding against, for example, the introduction guide member 452 (refer to FIG. 5) to be bent, or prevented from being jammed before arriving at the transporter 45.

Thus, in the feeder 1, regardless of when the left and right edge portions of the sheet-shaped media 9 (9A) stacked on the mount portion 20A or 20B are bent downward, transport errors or transport failures of the sheet-shaped media 9 (9A) are prevented further than in the case where the first operation A is not performed.

As illustrated in FIG. 14, in the feeder 1, when the controller 15 determines that the detection information indicating that the bend amount is greater than or equal to the threshold Kd is from either one of the left and right detectors 74L and 74R, not from both, whether the detection information is from the left or right is determined.

Here, in the feeder 1, when the controller 15 determines that the detection information greater than or equal to the threshold Kd is from the left detector 74L, an operation (first operation B1) of increasing the air flow from the air outlets 50C and 50D forming the right edge air blower is performed as the first operation B. As in the case of the first operation A, the first operation B1 is also performed until the suction operation is finished.

Figure 18A:
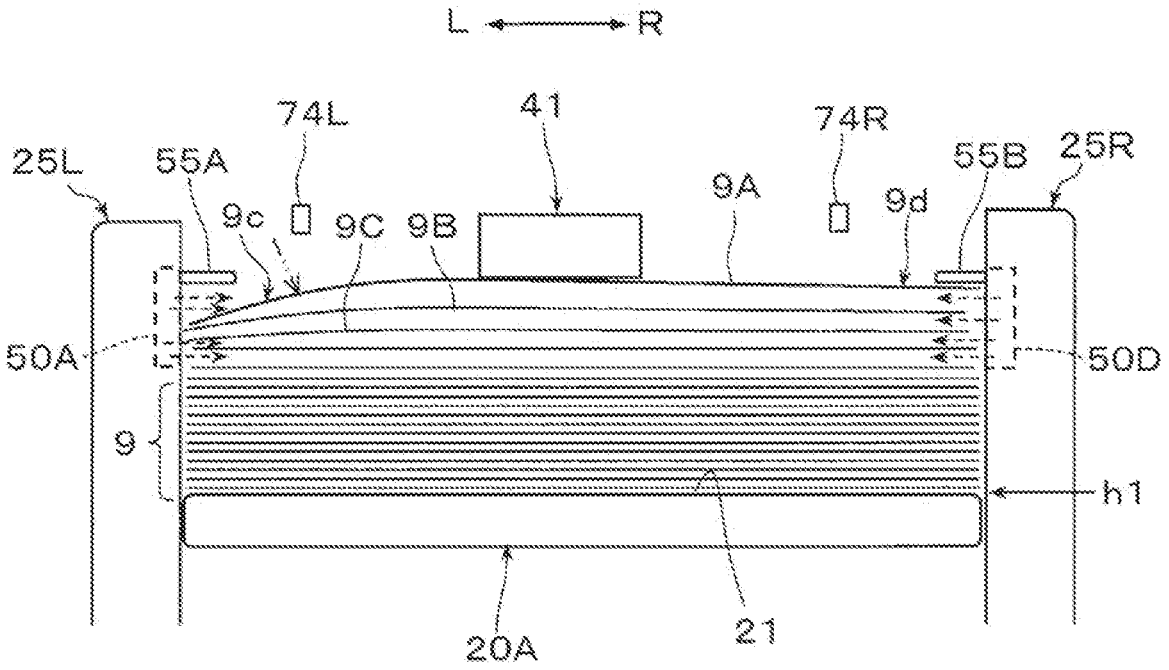
FIG. 18A is a schematic view of an example state before performance of the first operation in FIG. 17.

As illustrated in FIGS. 17 and 18A by way of example, the case where only the detection information from the left detector 74L is determined as being greater than or equal to the threshold Kd corresponds to the case where the left edge portion of at least the uppermost sheet-shaped medium 9A is bent downward by a predetermined amount or more. In this case, as illustrated in FIG. 18A by way of example, air (broken arrow) blown from, for example, the left air outlet 50A collides against the upper surface of the downwardly bent left edge portion of the uppermost sheet-shaped medium 9A, and then is further bent to push the left edge portion 9*c* downward.

The first operation B1 is an operation of increasing the air flow blown from the air outlets 50C and 50D forming the right edge air blower. Thus, the first operation B1 is performed by the controller 15 as a control of increasing the air flow from the right edge air blowing device 61R forming the right edge air blower.

Figure 18B:
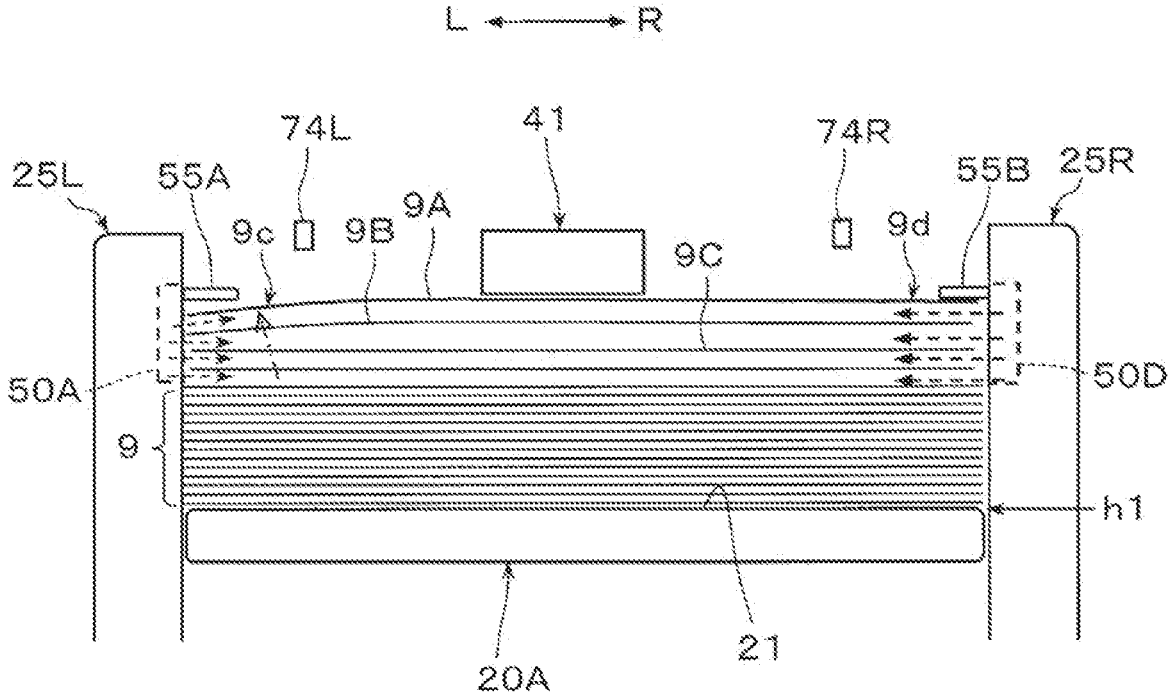
FIG. 18B is a schematic view of an example state change after the first operation is performed in FIG. 17.

Thus, as illustrated in FIG. 18B by way of example, in the feeder 1, the increased air flow (longer broken arrows) from, for example, the air outlet 50D forming the right edge air blower flows between right edge portions of the upper sheet-shaped media 9T including the uppermost sheet-shaped medium 9A. This increased air flow flows to the left edge portion 9*c* of the uppermost sheet-shaped medium 9A to push up the bent downward left edge portion 9*c* from the lower surface. The same applies to the downwardly bent left edge portion of the second uppermost sheet-shaped medium 9B.

Thus, as illustrated in FIG. 18B, the uppermost sheet-shaped medium 9A is raised to have the downwardly bent left edge portion raised upward, and to reduce the height difference Δh (left height difference Δh1) in the width direction.

When the downwardly bent left edge portion of the uppermost sheet-shaped medium 9A is raised, the height difference Δh of the entire medium 9A in the width direction is reduced. Thus, as illustrated in FIG. 18B with broken arrows by way of example, air blown from, for example, the air outlet 50A forming the left edge air blower is more likely to smoothly flow between the uppermost sheet-shaped medium 9A and the second uppermost sheet-shaped medium 9B and between the left and right edge portions of the raised upper sheet-shaped media 9T. The intervention of air separates the media therebetween.

Here, the first operation B1 is stopped when the controller 15 determines that both the bend amounts ΔK detected by the left and right detectors 74L and 74R fall below the threshold Kd.

The feeder 1 finishes the first operation B1 with the above operation. When the feeder 1 finishes the first operation B1, the air flow blown from the right edge air blowing device 61R is returned to the normal flow rate under the control of the controller 15. With the completion of the first operation B1, the suction operation is also finished.

Subsequently, in the feeder 1, the suction portion 41 moves forward from the suction position to the delivery position, and air is blown from the air nozzle 48 in the tip-end air blower.

Here, as illustrated in FIG. 18B, the uppermost sheet-shaped medium 9A sucked by the suction portion 41 is separated from the second uppermost sheet-shaped medium 9B, and has the downwardly bent left edge portion raised.

Thus, the uppermost sheet-shaped medium 9A here is separated from the second uppermost sheet-shaped medium 9B with air blown from the air nozzle 48, and is thus prevented from being passed to the transporter 45 together with the second uppermost sheet-shaped medium 9B or prevented from being transported in an overlapped manner. The uppermost sheet-shaped medium 9A is prevented from having the left corner at the leading end accidentally colliding against, for example, the introduction guide member 452 (refer to FIG. 5) to be bent, or prevented from being jammed before arriving at the transporter 45.

Thus, in the feeder 1, regardless of when the left edge portions of the sheet-shaped media 9 (9A) stacked on the mount portion 20A or 20B are bent downward, transport errors or transport failures of the sheet-shaped media 9 (9A) are prevented further than in the case where the first operation B1 is not performed.

As illustrated in FIG. 14, in the feeder 1, when the controller 15 determines that the detection information from the right detector 74R is greater than or equal to the threshold Kd, the operation (first operation B2) of increasing the air flow from the air outlets 50A and 50B forming the left edge air blower is performed as the first operation B. As in the case of the first operation A, the first operation B2 is also performed until the suction operation is finished.

Figure 20A:
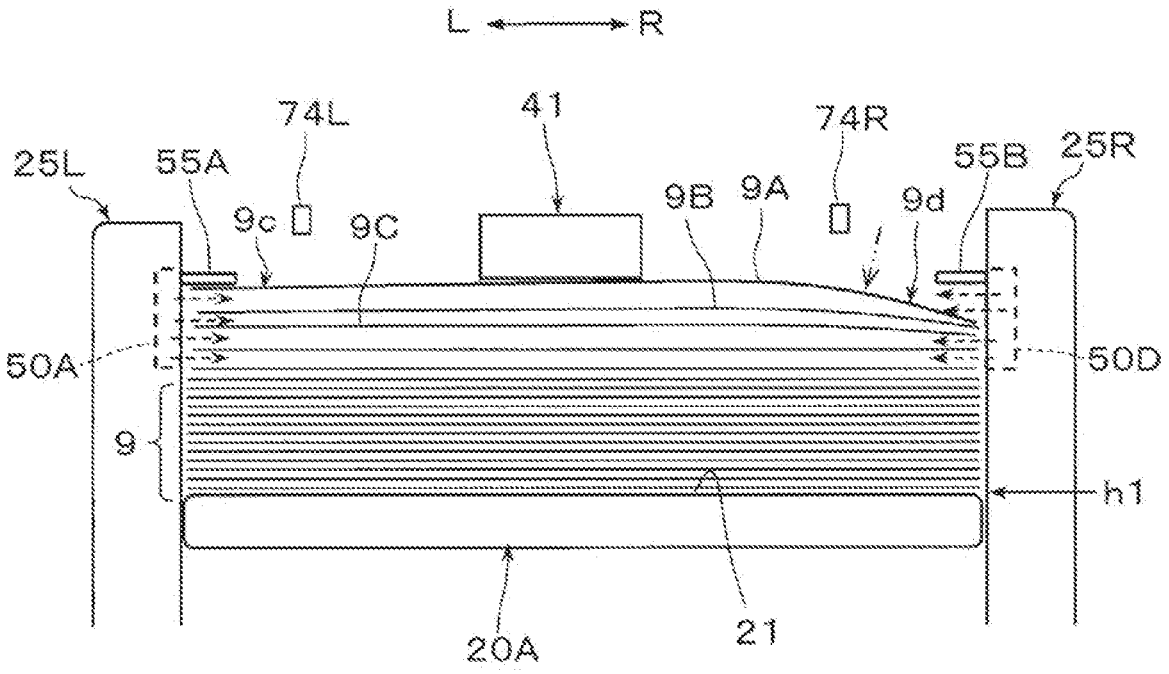
FIG. 20A is a schematic view of an example state before performance of the first operation in FIG. 19.

As illustrated in FIGS. 19 and 20A by way of example, the case where only the detection information from the right detector 74R is determined as being greater than or equal to the threshold Kd corresponds to the case where the right edge portion of at least the uppermost sheet-shaped medium 9A is bent downward by a predetermined amount or more. In this case, as illustrated in FIG. 20A by way of example, the air flow (broken arrows) blown from, for example, the right air outlet 50D collides against the upper surface of the downwardly bent right edge portion of the uppermost sheet-shaped medium 9A, and then is further bent to push the right edge portion 9*d* downward.

The first operation B2 is an operation of increasing the air flow blown from the air outlets 50A and 50B forming the left edge air blower. Thus, the first operation B2 is performed by the controller 15 as a control of increasing the air flow from the left edge air blowing device 61L forming the left edge air blower.

Figure 20B:
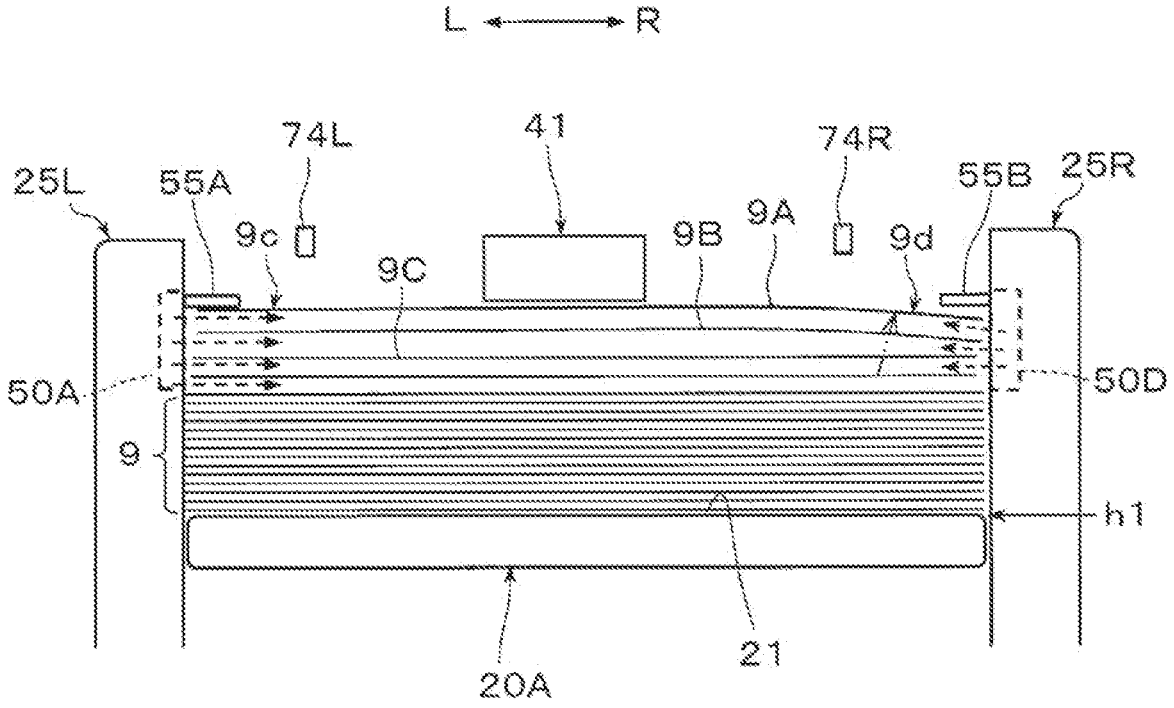
FIG. 20B is a schematic view of an example state change after the first operation is performed in FIG. 19.

Thus, in the feeder 1, as illustrated in FIG. 20B by way of example, the increased air flow (longer broken arrows) from, for example, the air outlet 50A forming the left edge air blower flows between left edge portions of the upper sheet-shaped media 9T including the uppermost sheet-shaped medium 9A. This increased air flow flows to the right edge portion 9*d* of the uppermost sheet-shaped medium 9A to push up the right edge portion 9*d* bent downward from the lower surface. The same applies to the downwardly bent right edge portion of the second uppermost sheet-shaped medium 9B.

Thus, as illustrated in FIG. 20B, the uppermost sheet-shaped medium 9A is raised to have the downwardly bent right edge portion raised upward to reduce the height difference Δh (right height difference Δh2) in the width direction.

When the downwardly bent right edge portion of the uppermost sheet-shaped medium 9A is raised, the height difference Δh of the entire medium 9A in the width direction is reduced. Thus, as illustrated in FIG. 20B with broken arrows by way of example, the air flow blown from, for example, the air outlet 50D forming the right edge air blower is more likely to smoothly flow between the uppermost sheet-shaped medium 9A and the second uppermost sheet-shaped medium 9B and between the left and right edge portions of the raised upper sheet-shaped media 9T. The intervention of air separates the media therebetween.

Here, the first operation B2 is stopped when the controller 15 determines that both the bend amounts ΔK detected by the left and right detectors 74L and 74R fall below the threshold Kd.

The feeder 1 finishes the first operation B2 with the above operation.

When the feeder 1 finishes the first operation B2, the air flow blown from the left edge air blowing device 61L is returned to the normal flow rate under the control of the controller 15. With the completion of the first operation B2, the suction operation is also finished.

Thereafter, as in the case of the first operation B1, the remaining operations in the feeding operation is continued.

As illustrated in FIG. 20B, here, the uppermost sheet-shaped medium 9A sucked by the suction portion 41 is separated from the second uppermost sheet-shaped medium 9B, and has the downwardly bent left edge portion raised.

Thus, the uppermost sheet-shaped medium 9A here is prevented from being passed to the transporter 45 together with the second uppermost sheet-shaped medium 9B or prevented from being transported in an overlapped manner. The uppermost sheet-shaped medium 9A is prevented from having the right corner at the leading end accidentally colliding against, for example, the introduction guide member 452 (refer to FIG. 5) to be bent, or prevented from being jammed before arriving at the transporter 45.

Thus, in the feeder 1, regardless of when the right edge portions of the sheet-shaped media 9 (9A) stacked on the mount portion 20A or 20B are bent downward, transport errors or transport failures of the sheet-shaped media 9 (9A) are prevented further than in the case where the first operation B2 is not performed.

In the first exemplary embodiment, the first operation B1 or B2 may additionally include an operation of raising the mount portion 20A or 20B to a position higher than the current position as an example of the first operation A.

The height position ht of raising the mount portion 20A here may be the same position as the height position ht in the first operation A. However, to take a synergic effect, the height position ht is preferably lower than the height position ht in the first operation A.

When the operation of raising the mount portion 20A or 20B to a position higher than the current position is additionally performed as the first operation A while the first operation B1 or B2 is performed, the uppermost sheet-shaped medium 9A even with the left or right edge portion 9*c* or 9*d* bent downward is transported with less transport errors or transport failures compared to the case where the additional operation is not performed.

Second Exemplary Embodiment

Figure 21:
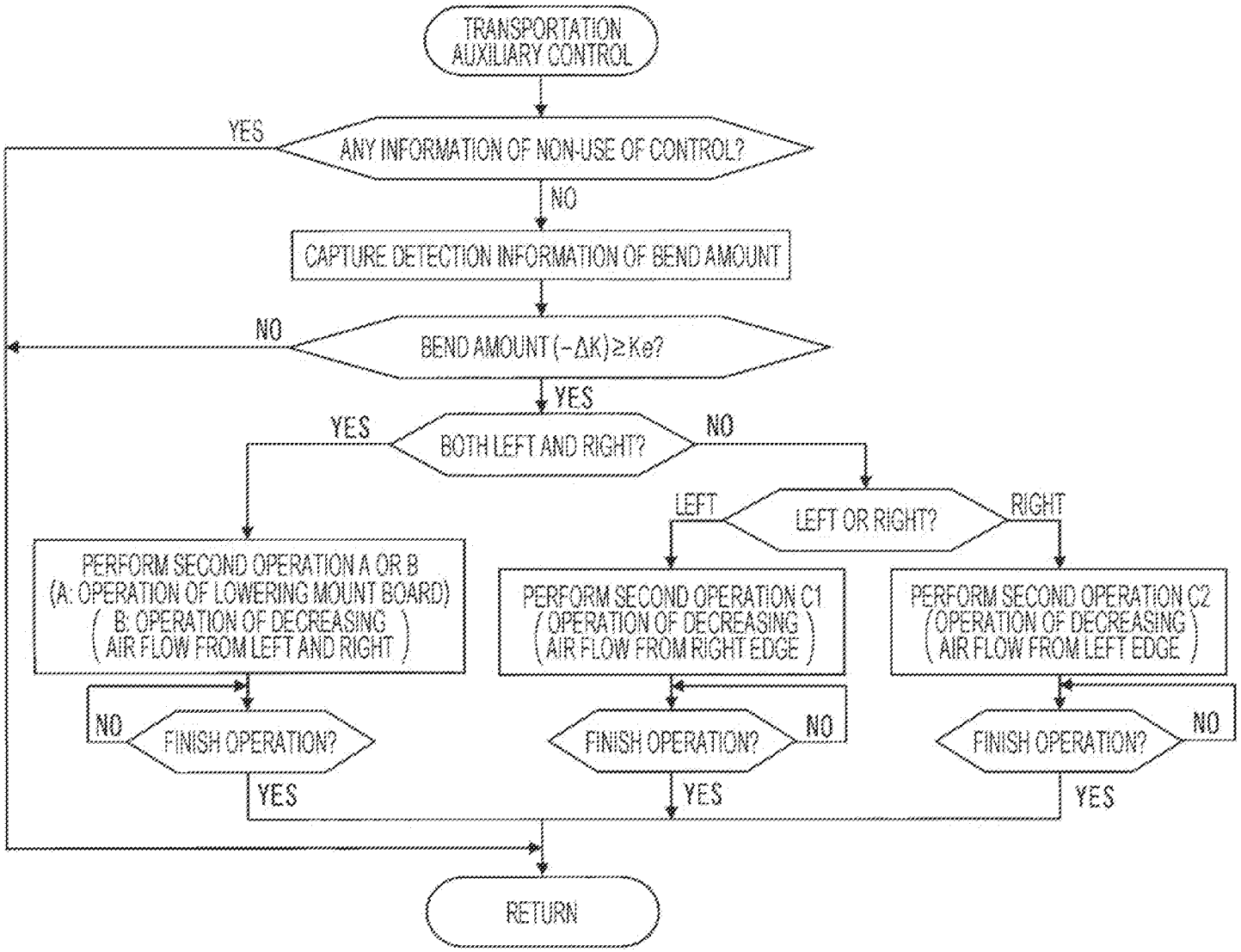
FIG. 21 is a flowchart of transportation auxiliary control of a feeder according to a second exemplary embodiment including a second operation.

FIG. 21 illustrates a portion (structure relating to transportation auxiliary control) of a sheet-shaped-medium feeder 1 according to a second exemplary embodiment.

The feeder 1 according to the second exemplary embodiment and the feeder 1 according to the first exemplary embodiment have the same structure except that the first operation in the transportation auxiliary control is changed to a second operation. Thus, in the following description and the drawings, the same components are denoted with reference signs the same as those in the first exemplary embodiment without description otherwise needed.

Figure 22:
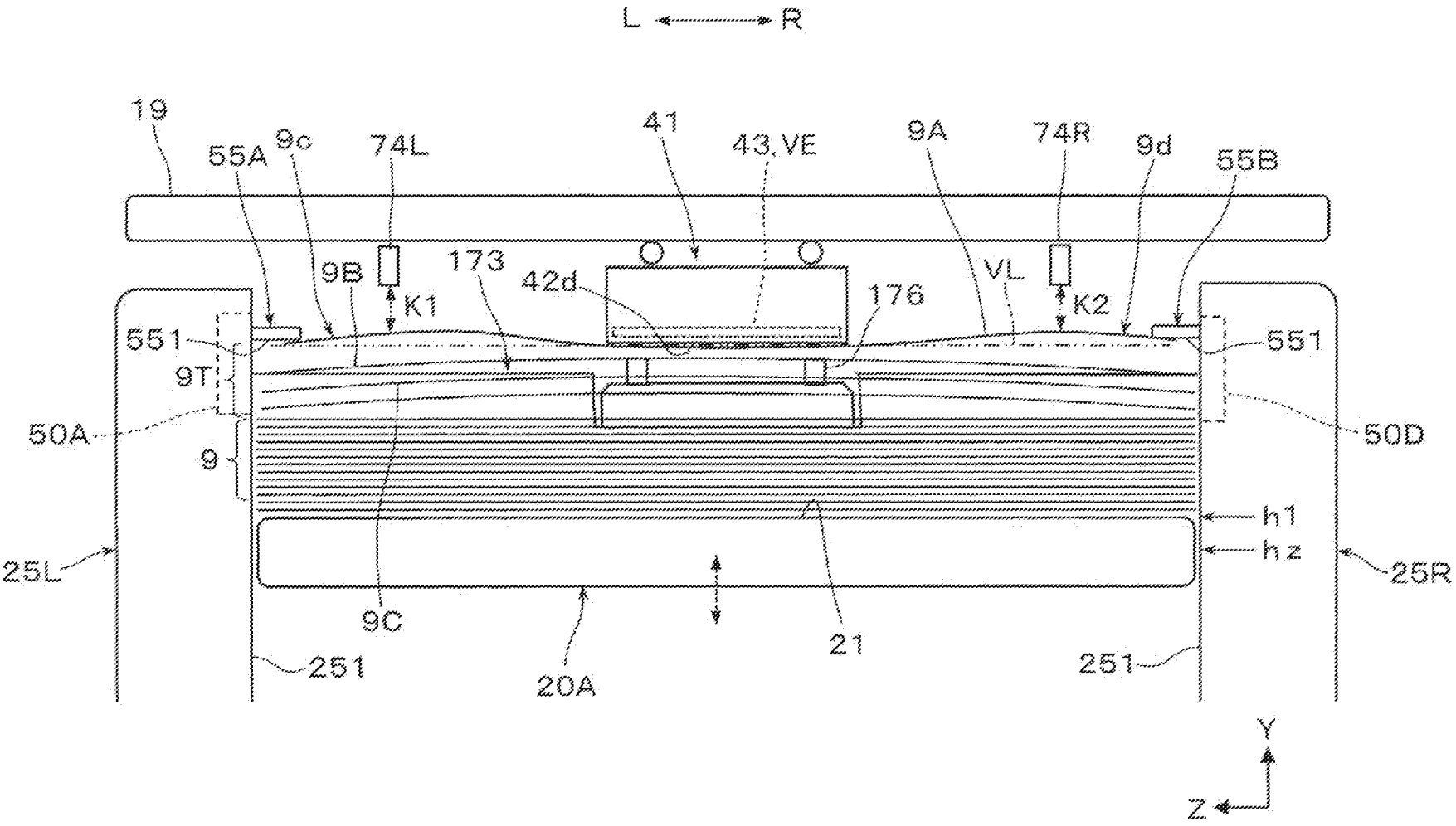
FIG. 22 is a schematic view of an example state in an operation of feeding a sheet-shaped medium with upwardly bent left and right edge portions.
Figure 24A:
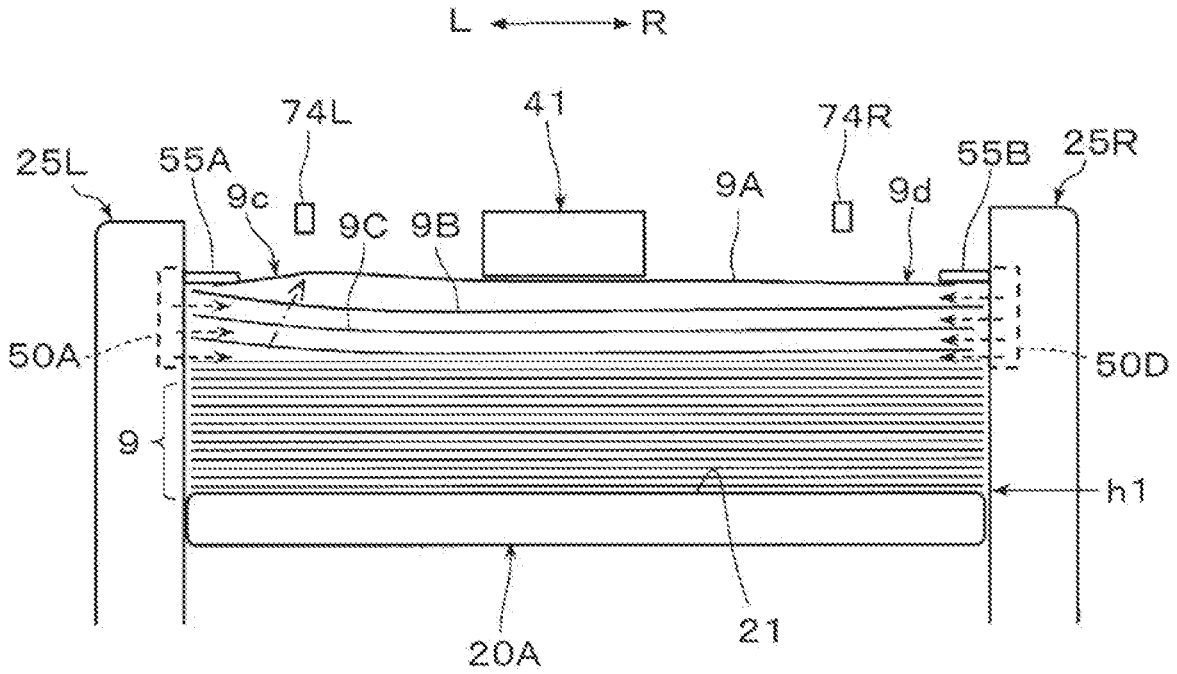
FIG. 24A is a schematic view of another example state in a feeding operation involving the second operation.
Figure 25A:
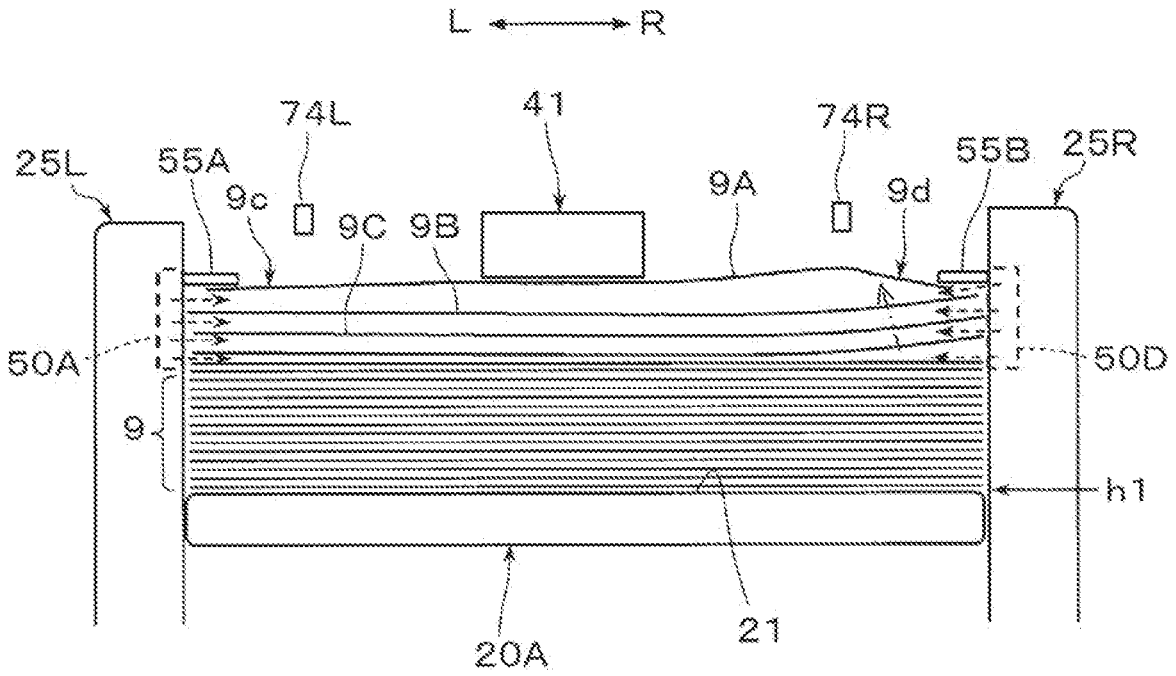
FIG. 25A is a schematic view of another example state in a feeding operation involving the second operation.

As illustrated in FIGS. 22, 24A, and 25A and other drawings by way of example, the second operation according to the second exemplary embodiment is an operation of reducing, when either one or both of the left and right detectors 74L and 74R detect that the upward bend amount is greater than or equal to a predetermined amount, the contact strength with which part of the upper surface of the uppermost sheet-shaped medium 9A comes into contact with components 5 such as the height limiters 55.

As in the case of the controller 15 according to the first exemplary embodiment, when obtaining detection information from the detectors 74L and 74R, the controller 15 determines whether each bend amount ΔK serving as the detection information is greater than or equal to a predetermined threshold Ke as a determination step of transportation auxiliary control involving the second operation.

The threshold Ke is set as appropriate in consideration of the state in the feeding operation where transport errors or failures are more likely to occur, because transport errors or transport failures described in the first exemplary embodiment also occur in the operation of feeding the uppermost sheet-shaped medium 9A with either one or both of the upwardly bent left and right edge portions. The threshold Ke may also be set to, for example, a value smaller than a height difference ks (refer to FIG. 12) between the reference height VL or the height of the lowest portion 42*a* of the suction portion 41 and an upper end of the leading-end wall 173 (or an upper end of each stopper 176).

The second operation may be any operation of reducing the contact strength with which part of the upper surface of the uppermost sheet-shaped medium 9A with part of one of or both of the left and right edge portions 9*c* and 9*d* bent downward a predetermined amount or more comes into contact with the height limiters 55. In the exemplary embodiment, the following operation is employed.

Specifically, as illustrated in FIGS. 21 to 23A, an example employed as the second operation is an operation (second operation A) of lowering the mount portion 20A to a position below the current position when either one or both of the left and right detectors 74L and 74R detect that the upward bend amount ΔK is greater than or equal to a specific amount or a threshold Ke.

Figure 23A:
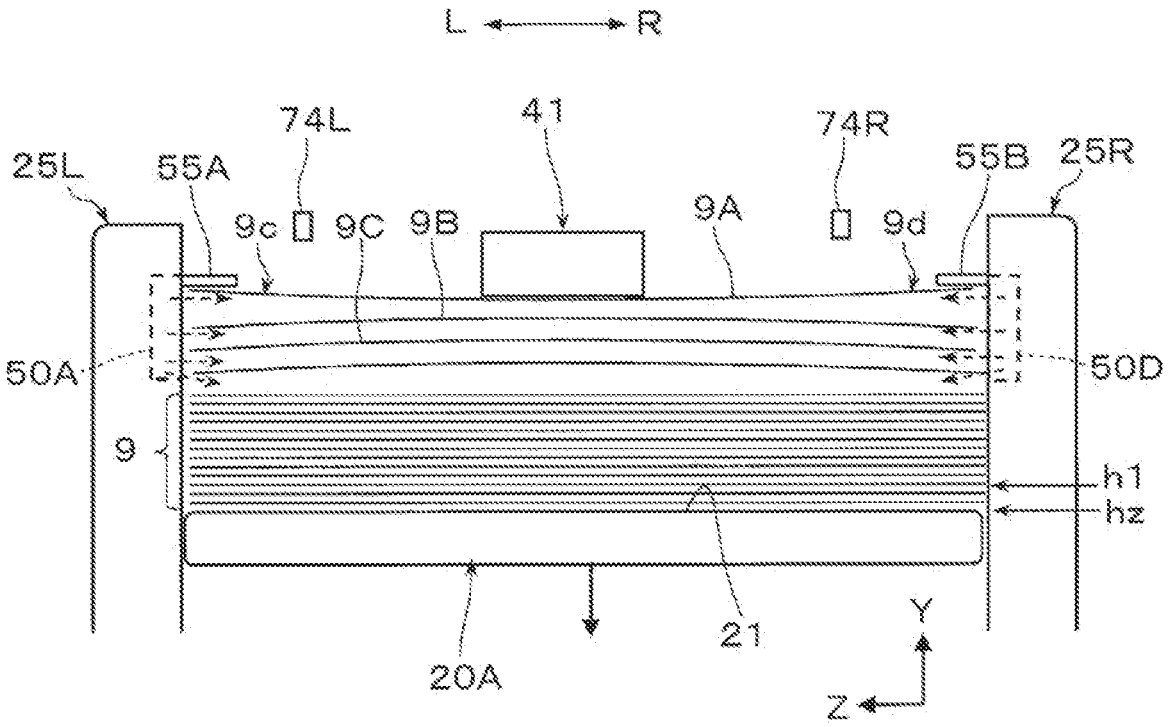
FIG. 23A is a schematic view of an example state change in the second operation.
Figure 23B:
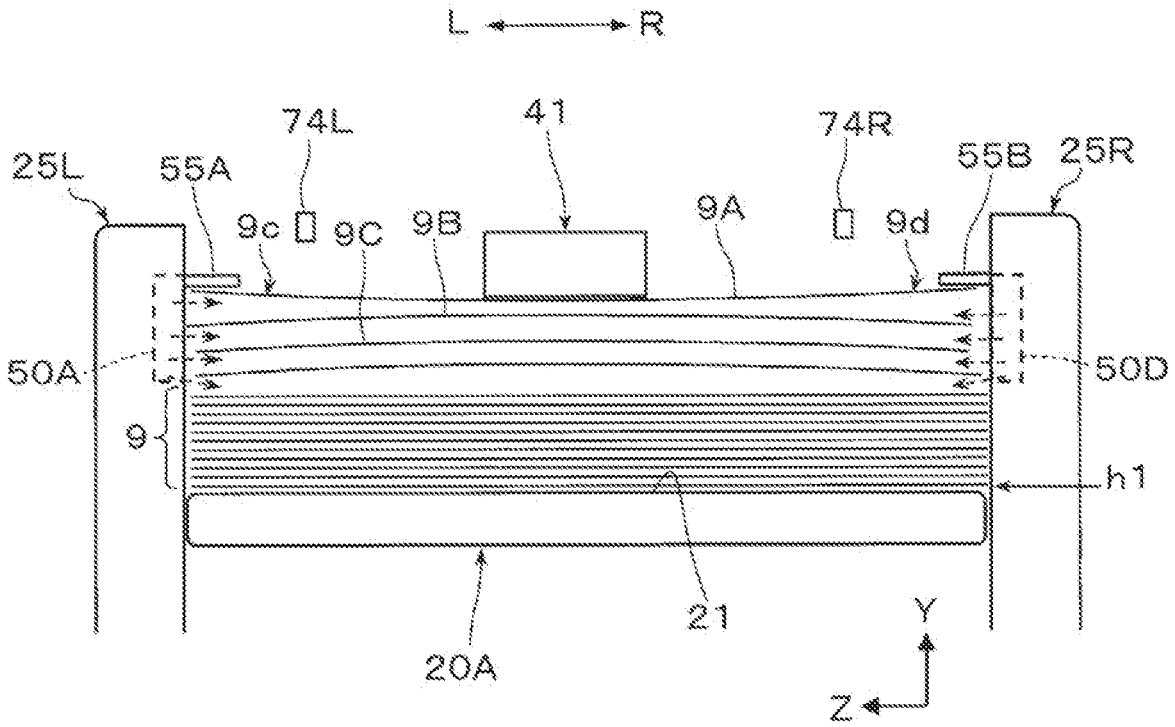
FIG. 23B is a schematic view of another example state change in the second operation.

As illustrated in FIGS. 21 and 23B, instead of the second operation A, the second operation may involve an operation (second operation B) of, when both of the left and right detectors 74L and 74R detect that the upward bend amount ΔK is greater than or equal to the specific amount or the threshold Ke, reducing the air flow from the air outlets 50 on the left and right edge air blowers.

As illustrated in FIGS. 21, 24A, 24B, 25A and 25B and other drawings, an example employed as the second operation is an operation (second operation C) of, when the left or right detector 74L or 74R detects that the downward bend amount ΔK is greater than or equal to the specific amount or the threshold Ke, reducing the air flow from either the left or right edge air blower on the same side of the detector 74L or 74R that has detected the bend amount greater than or equal to the threshold Ke.

Here, the amount by which the mount portion 20A is lowered from the current position is set to a distance required to reduce the contact strength with which the upwardly bent end portions 9*c* and 9*d* in the uppermost sheet-shaped medium 9A come into contact with the height limiters 55. This distance for reduction may be set to, for example, a value greater than or equal to the threshold Ke.

The operation of lowering the mount portion 20A or 20B is performed by a mount base 20 and other components lowering the lift driving apparatus 37 in the lift 30 by a predetermined amount.

The degree of reducing the air flow from the air outlets 50 forming the left and right edge air blowers is set to a value of wind power (flow rate or speed) required to reduce the contact strength with which the upwardly bent end portions 9*c* and 9*d* in the uppermost sheet-shaped medium 9A come into contact with the height limiters 55.

The operation of reducing the air flow from the edge air blowers is performed by reducing the driving rate of either one or both of the left and right edge air blowing devices 61L and 61R in the left and right edge air blowers or by reducing the degree of opening of the open-close valve.

Other structure relating to the transportation auxiliary control involving the second operation is substantially the same as the structure of the transportation auxiliary control according to the first exemplary embodiment.

Transportation Auxiliary Control

As illustrated in FIG. 21, when the feeder 1 capable of performing the transportation auxiliary control starts the operation of feeding the sheet-shaped media 9, the controller 15 firstly determines whether there is any information of non-use of the transportation auxiliary control.

Here, when the controller 15 determines that there is information of non-use of the transportation auxiliary control, the feeder 1 determines not to perform the transportation auxiliary control in the currently requested series of feeding operations. In contrast, when the controller 15 determines that there is no information of non-use of the transportation auxiliary control, the following information processing is performed.

Subsequently, in the feeder 1, the controller 15 captures the detection information of the bend amounts ΔK (K1-kc and K2-kc) detected by the left and right detectors 74L and 74R, and determines whether the bend amounts ΔK are greater than or equal to the threshold Ke.

As described above, the detectors 74L and 74R perform detection while the uppermost sheet-shaped medium 9A is sucked by the suction portion 41. The bend amounts ΔK are negative values because the actually measured heights K2 exceed the two-dot chain line VL serving as a reference line. Thus, the bend amounts ΔK are regarded as absolute values with reference to the threshold Ke.

Here, when the bend amounts ΔK are determined as being smaller than the threshold Ke, in the feeding operation, the transportation auxiliary control is regarded as being not required, and not performed. When at least one of the bend amounts ΔK is determined as being greater than or equal to the threshold Ke, whether the detection information is from either one or both of the left and right detectors 74L and 74R is determined.

In the feeder 1, when the controller 15 determines that the detection information from both the left and right detectors 74L and 74R is greater than or equal to the threshold Kd, the second operation A is performed until the suction operation is finished.

The second operation A is an operation of lowering the mount portion 20A or 20B lower than the current position h1. Thus, the second operation A is performed by the controller 15 as a control of operating the lift driving apparatus 37 to lower the mount portion 20A or 20B until the mount surface 21 is lowered to the predetermined height position hs (refer to FIG. 23A).

Thus, in the feeder 1, as illustrated in FIG. 23A, in the state where the uppermost sheet-shaped medium 9A is sucked by the suction portion 41, the mount portion 20A is lowered to and stopped at the predetermined height position hs.

The height position hs at which the mount portion 20A is stopped may be a predetermined height position (shift amount), or a height position at which the mount portion 20A is controlled to be stopped when the bend amounts ΔK detected by the left and right detectors 74L and 74R fall below the threshold Ke. In a structure where the mount portion 20A is stopped after being lowered by a predetermined shift amount in the second operation A, the shift amount may be changed by, for example, a user.

Thus, in the feeder 1, the mount portion 20A is separated away from the suction portion 41, the sheet-shaped media 9 stacked on the mount surface 21 are also separated away from the suction portion 41, and the stacked sheet-shaped media 9 and the raised upper sheet-shaped media 9 are separated from and below the uppermost sheet-shaped medium 9A. This reduces (or weakens) the effect of the stacked sheet-shaped media 9 and the raised upper sheet-shaped media 9 and air flow from the air outlets 50 to push the uppermost sheet-shaped medium 9A upward.

As illustrated in FIG. 23A, the uppermost sheet-shaped medium 9A thus has a portion, except for a center portion sucked by the suction portion 41, slightly sagged downward, and the contact strength with which the left and right edge portions 9*c* and 9*d* come into contact with, for example, the height limiters 55A and 55B is weakened.

As the second uppermost sheet-shaped medium 9B and other media sag downward, air that flows from the air outlets 50A and 50D of the edge air blowers is more likely to smoothly flow between the left and right edge portions of the uppermost sheet-shaped medium 9A and the left and right edge portions of the second uppermost sheet-shaped medium 9B. Thus, the uppermost sheet-shaped medium 9A and the second uppermost sheet-shaped medium 9B are spaced apart from each other with intervention of air.

The second operation A here is stopped when the controller 15 determines that both the bend amounts ΔK detected by the left and right detectors 74L and 74R fall below the threshold Kd.

In the feeder 1, the second operation A is finished with the above operation.

In the feeder 1, when the second operation A is finished, the mount portion 20A or 20B stopped at the height position hs is raised to the original height position h1 under the control of the controller 15. With the completion of the second operation A, the suction operation is finished.

Subsequently, in the feeder 1, the suction portion 41 moves forward from the suction position to the delivery position, and air is blown from the air nozzle 48 in the tip-end air blower.

As illustrated in FIG. 23A, the uppermost sheet-shaped medium 9A sucked by the suction portion 41 here is spaced apart from the second uppermost sheet-shaped medium 9B.

Thus, the uppermost sheet-shaped medium 9A spaced apart from the second uppermost sheet-shaped medium 9B with air blown from the air nozzle 48 is prevented from being passed to the transporter 45 together with the second uppermost sheet-shaped medium 9B or prevented from being transported in an overlapped manner. The uppermost sheet-shaped medium 9A is prevented from having the left and right corners at the leading end accidentally colliding against, for example, the introduction guide member 452 (refer to FIG. 5) to be bent, or prevented from being jammed before arriving at the transporter 45.

Thus, in the feeder 1, regardless of when the left and right edge portions of the sheet-shaped media 9 (9A) stacked on the mount portion 20A or 20B are bent upward, transport errors or transport failures of the sheet-shaped media 9 (9A) are prevented further than in the case where the second operation A is not performed.

Instead of the second operation A, as illustrated in FIG. 21 or 23B, the feeder 1 may perform the second operation B to reducing the air flow from the air outlets 50 forming the left and right edge air blowers.

Also when the second operation B is performed, the change of the state or operational effects substantially the same as those obtained when the second operation A is performed are obtained.

As illustrated in FIG. 21, in the feeder 1, when the controller 15 determines that the detection information greater than or equal to the threshold Ke is not from both the left and right detectors 74L and 74R, whether the detection information is from the left or right is determined.

Here, when the controller 15 determines that the detection information greater than or equal to the threshold Ke is from the left detector 74L, the feeder 1 performs an operation (second operation C1) of reducing the air flow from the air outlets 50C and 50D forming the right edge air blower as the second operation. As in the case of the second operation A, the second operation C1 is also performed until the suction operation is finished.

The case where the detection information from only the left detector 74L is determined as being greater than or equal to the threshold Kd corresponds to the case where, as illustrated in FIG. 24A by way of example, the upwardly bent left edge portion of the at least uppermost sheet-shaped medium 9A is pressed against the height limiter 55A from below the height limiter 55A and a portion apart from and inward of the height limiter 55A is bent upward by a predetermined amount or more.

The second operation C1 is an operation of reducing the air flow from the air outlets 50A and 50B forming the left edge air blower. Thus, the second operation C1 is performed by the controller 15 as a control of reducing the air flow from the left edge air blowing device 61L forming the left edge air blower.

Figure 24B:
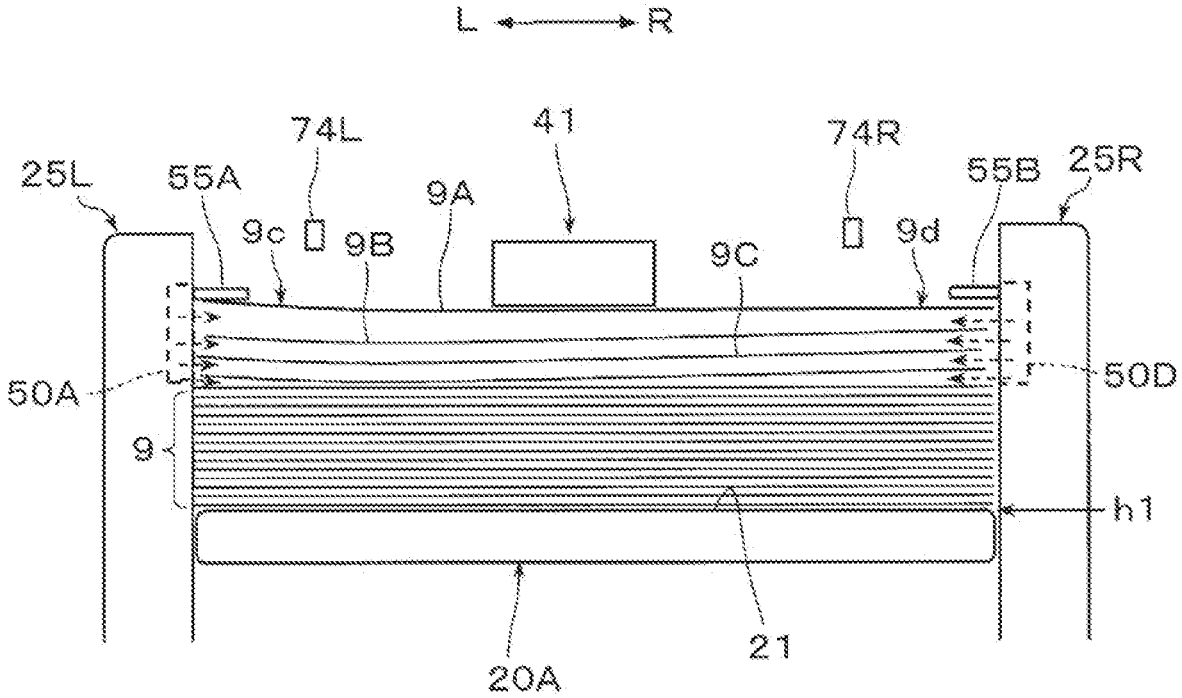
FIG. 24B is a schematic view of an example state change after the second operation is performed illustrated in FIG. 24A.

As illustrated in FIG. 24B by way of example, in the feeder 1, the reduced air flow (shorter broken arrows) from, for example, the air outlet 50A forming the left edge air blower slightly lowers the left edge portions 9*c* of the raised sheet-shaped media 9 including the uppermost sheet-shaped medium 9A. This reduces (or weakens) the effect of the left edge portions of the raised upper sheet-shaped media 9 of pushing the left edge portion 9*c* of the uppermost sheet-shaped medium 9A upward.

Thus, as illustrated in FIG. 24B, the left edge portion 9*c* of the uppermost sheet-shaped medium 9A is slightly lowered, and the contact strength with which the left edge portion 9*c* comes into contact with, for example, the height limiter 55A is reduced.

Since the left edge portions of the second uppermost sheet-shaped medium 9B and other media are lowered, air flow from, for example, the air outlet 50A of the edge air blower is more likely to smoothly flow between the left edge portion of the uppermost sheet-shaped medium 9A and the left edge portion of the second uppermost sheet-shaped medium 9B. Thus, the uppermost sheet-shaped medium 9A and the second uppermost sheet-shaped medium 9B have their left edge portions spaced apart from each other with intervention of air.

Here, the second operation C1 is stopped when the controller 15 determines that both the bend amounts ΔK detected by the left and right detectors 74L and 74R fall below the threshold Ke.

In the feeder 1, the second operation C1 is finished with the above operation. In the feeder 1, when the second operation C1 is finished, the air flow from the left edge air blowing device 61L is returned to the normal rate under the control of the controller 15. With the completion of the second operation C1, the suction operation is finished.

Subsequently, in the feeder 1, the suction portion 41 moves forward from the suction position to the delivery position, and air is blown from the air nozzle 48 in the tip-end air blower. In the following feeding operation, substantially the same effects are obtained as those obtained in the second operation B.

Thus, in the feeder 1, regardless of when the left edge portions of the sheet-shaped media 9 (9A) stacked on the mount portion 20A or 20B are bent upward, transport errors or transport failures of the sheet-shaped media 9 (9A) are prevented further than in the case where the second operation C1 is not performed.

When the controller 15 determines that the detection information greater than or equal to the threshold Ke is from the right detector 74R, as illustrated in FIG. 21, the feeder 1 performs an operation (second operation C2) of reducing the air flow from the air outlet 50D forming the right edge air blower as an example of the second operation.

The case where only the detection information from the right detector 74R is determined as being greater than or equal to the threshold Ke corresponds to the case where, as illustrated in FIG. 25A by way of example, the upwardly bent right edge portion of at least the uppermost sheet-shaped medium 9A is pressed against the height limiter 55B from below the height limiter 55B and a portion apart from and inward of the height limiter 55B is bent upward by a predetermined amount or more.

The second operation C2 is an operation of reducing the air flow from the air outlets 50C and 50D forming the right edge air blower. Thus, the second operation C2 is performed by the controller 15 as a control of reducing the air flow from the right edge air blowing device 61R forming the right edge air blower.

Figure 25B:
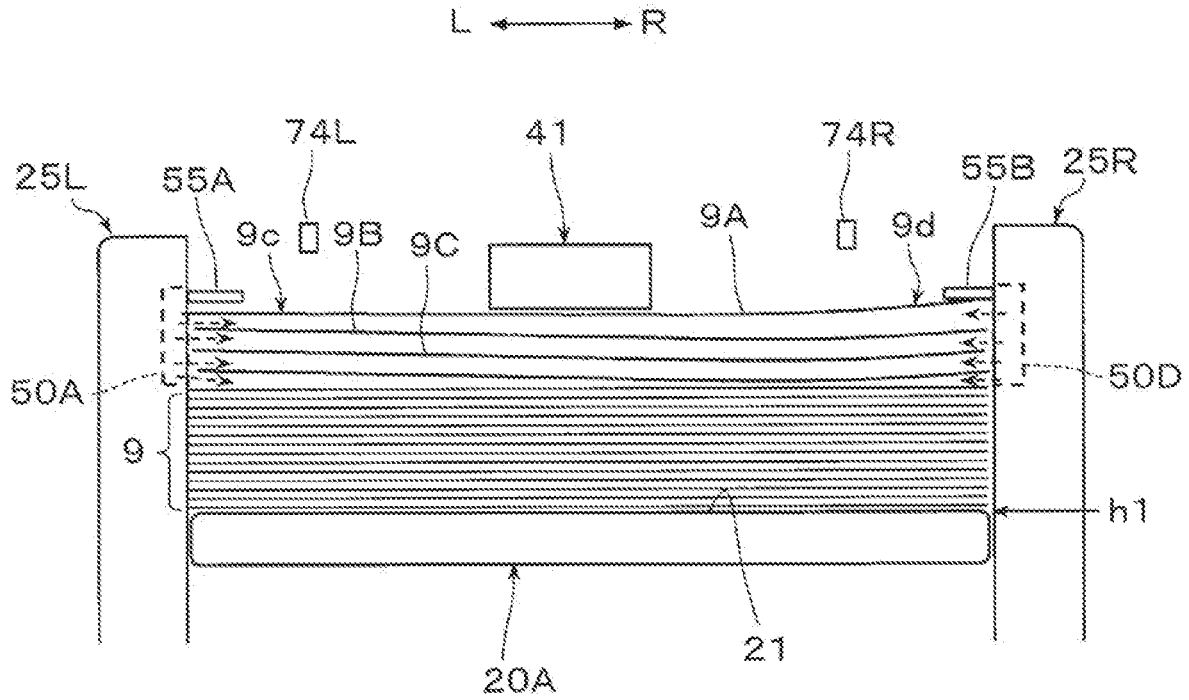
FIG. 25B is a schematic view of an example state change after the second operation is performed illustrated in FIG. 25A.

Thus, in the feeder 1, as illustrated in FIG. 25B by way of example, the reduced air flow (shorter broken arrows) from, for example, the air outlet 50D forming the right edge air blower slightly lowers the right edge portions 9*d* of the raised sheet-shaped media 9 including the uppermost sheet-shaped medium 9A. This reduces (or weakens) the effect of the right edge portions of the raised upper sheet-shaped media 9 of pushing the right edge portion 9*d* of the uppermost sheet-shaped medium 9A upward.

Thus, as illustrated in FIG. 25B, the right edge portion 9*d* of the uppermost sheet-shaped medium 9A is slightly lowered, and the contact strength with which the right edge portion 9*d* comes into contact with, for example, the height limiter 55B is reduced.

Since the right edge portions of the second uppermost sheet-shaped medium 9B and other media are lowered, air flow from, for example, the air outlet 50D of the edge air blower is more likely to smoothly flow between the right edge portion of the uppermost sheet-shaped medium 9A and the right edge portion of the second uppermost sheet-shaped medium 9B. Thus, the uppermost sheet-shaped medium 9A and the second uppermost sheet-shaped medium 9B have their right edge portions spaced apart from each other with intervention of air.

Here, the second operation C2 is stopped when the controller 15 determines that both the bend amounts ΔK detected by the left and right detectors 74L and 74R fall below the threshold Ke.

In the feeder 1, the second operation C2 is finished with the above operation. In the feeder 1, when the second operation C1 is finished, the air flow from the right edge air blowing device 61R is returned to the normal rate under the control of the controller 15. With the completion of the second operation C2, the suction operation is finished.

Subsequently, in the feeder 1, the suction portion 41 moves forward from the suction position to the delivery position, and air is blown from the air nozzle 48 in the tip-end air blower. In the following feeding operation, substantially the same effects are obtained as those obtained in the second operation B.

Thus, in the feeder 1, regardless of when the right edge portions of the sheet-shaped media 9 (9A) stacked on the mount portion 20A or 20B are bent upward, transport errors or transport failures of the sheet-shaped media 9 (9A) are prevented further than in the case where the second operation C2 is not performed.

MODIFICATION EXAMPLES

The disclosure is not limited to the structure examples illustrated in the exemplary embodiments, and may include modification examples described below.

In the first exemplary embodiment, when the first operation is performed, the second operation according to the second exemplary embodiment may be performed in combination.

In the second exemplary embodiment, instead of the height limiters 55, the components 5 with which the left and right edge portions 9*c* and 9*d* of the uppermost sheet-shaped medium 9A come into contact may be other than the height limiters 55.

Instead of or in addition to the above example of the second operation, an example employed as the second operation may be an operation of prompting turning of the upwardly bent sheet-shaped media 9 stacked on the mount base 20 and other components upside down. Here, for example, a message prompting the operation of turning the media upside down may be informed to a user by being displayed on the operation display device 16.

In each of the exemplary embodiments, as an example of the suction portion 41 in the feeder 1, a suction portion formed from a suction belt transport mechanism including a suction transport belt may be used. The suction transport belt rotates to transport the uppermost sheet-shaped medium 9A to the transporter 45 in the transportation direction D while attracting the uppermost sheet-shaped medium 9A to a belt lower surface.

Each exemplary embodiment has described, as an example of the sheet-shaped-medium handling apparatus 100, the image forming system 100A including the image forming apparatus 120A serving as the processing device 120, but this is not the only possible structure. The handling apparatus 100 may be any apparatus that includes the processing device 120 that performs predetermined processing on the sheet-shaped media 9 fed from the feeder 1.

Examples of the handling apparatus 100 include a printing system including the processing device 120 used as a printer that attaches ink to the sheet-shaped media 9 and other media, a painting system including the processing device 120 used as a painting device that applies a liquid paint to the sheet-shaped media 9 and other media, and a drying system including the processing device 120 used as a dryer that dries the sheet-shaped media 9 and other media.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A feeder comprising:

a mount board that moves vertically while allowing sheet-shaped media to be stacked thereon;

a transport device that allows an uppermost one of the sheet-shaped media stacked on the mount board to be sucked by a suction portion to transport the uppermost sheet-shaped medium to a transporter and to feed the uppermost sheet-shaped medium to a destination;

left and right edge air blowers that blow air to left and right edge portions, when viewed from an upstream side in a transportation direction, of upper ones of the sheet-shaped media stacked; and left and right detectors that are disposed on left and right sides of the suction portion at the same position in the transportation direction, and that individually detect downward or upward bend amounts of left and right edge portions of the uppermost sheet-shaped medium, wherein, when either one or both of the left and right detectors detect that the downward bend amount is greater than or equal to a specific amount, the feeder performs a first operation of reducing a height difference at a portion of the uppermost sheet-shaped medium in a transportation width direction.

2. The feeder according to claim 1, wherein the first operation is an operation of raising the mount board to a position higher than a current position when both of the left and right detectors detect that the downward bend amount is greater than or equal to a specific amount.

3. The feeder according to claim 1, wherein the first operation is an operation of increasing, when one of the left and right detectors detects that the downward bend amount is greater than or equal to a specific amount, an air flow from the left or right edge air blower on the same side as a side of the other one of the left and right detectors.

4. The feeder according to claim 3, wherein the first operation includes an operation of raising the mount board to a position higher than a current position.

5. The feeder according to claim 1, wherein the first operation is stopped after being performed when both the left and right detectors no longer detects that the downward bend amount is greater than or equal to a specific amount.

6. The feeder according to claim 1, wherein the first operation is not performed when sheet-shaped media with a small transportation width undetectable by the left and right detectors and a specific type of sheet-shaped media are used.

7. The feeder according to claim 1, wherein the left and right detectors are symmetrically disposed on left and right sides of the suction portion.

8. The feeder according to claim 7, comprising:

a leading-end wall disposed adjacent to a downstream end portion of the mount board in the transportation direction to align transportation leading ends of the stacked sheet-shaped media, wherein the left and right detectors are disposed upstream from the leading-end wall in the transportation direction.

9. The feeder according to claim 1, comprising:

a leading-end wall disposed adjacent to a downstream end portion of the mount board in the transportation direction to align transportation leading ends of the stacked sheet-shaped media, wherein the left and right detectors are disposed upstream from the leading-end wall in the transportation direction.

10. A sheet-shaped-medium handling apparatus, comprising:

a sheet-shaped-medium feeder that transports and feeds stacked sheet-shaped media to a destination; and a processing device that performs processing on the sheet-shaped media fed from the feeder, wherein the sheet-shaped-medium feeder includes the sheet-shaped-medium feeder according to claim 1.

11. A feeder comprising:

a mount board that moves vertically while allowing sheet-shaped media to be stacked thereon;

a transport device that allows an uppermost one of the sheet-shaped media stacked on the mount board to be sucked by a suction portion to transport the uppermost sheet-shaped medium to a transporter and to feed the uppermost sheet-shaped medium to a destination;

left and right edge air blowers that blow air to left and right edge portions, when viewed from an upstream side in a transportation direction, of upper ones of the sheet-shaped media stacked;

components that are disposed on left and right sides of the suction portion, and that allow part of an upper surface of the uppermost sheet-shaped medium raised with air flow from the left and right edge air blowers to come into contact therewith; and left and right detectors that are disposed on the left and right sides of the suction portion at the same position in the transportation direction, and that individually detect downward or upward bend amounts of left and right edge portions of the uppermost sheet-shaped medium, wherein when either one or both of the left and right detectors detect that the upward bend amount is greater than or equal to a specific amount, the feeder performs a second operation of reducing contact strength with which part of the upper surface of the uppermost sheet-shaped medium comes into contact with the components.

12. The feeder according to claim 11, wherein the second operation is an operation of lowering the mount board to a position below a current position.

13. The feeder according to claim 11, wherein the second operation is an operation of reducing an air flow from the left and right edge air blowers when both the left and right detectors detect that the upward bend amount is greater than or equal to a specific amount.

14. The feeder according to claim 11, wherein the second operation is an operation of reducing, when one of the left and right detectors detects that the upward bend amount is greater than or equal to a specific amount, an air flow from either the left or right edge air blower on the same side as a side of the one of the left and right detectors.

15. The feeder according to claim 11, wherein the second operation is an operation of prompting turning of the sheet-shaped media stacked on the mount board upside down.

16. The feeder according to claim 11, wherein the second operation is not performed when sheet-shaped media with a small transportation width undetectable by the left and right detectors and a specific type of sheet-shaped media are used.

17. The feeder according to claim 11, wherein the left and right detectors are symmetrically disposed on left and right sides of the suction portion.

18. The feeder according to claim 17, comprising:

a leading-end wall disposed adjacent to a downstream end portion of the mount board in the transportation direction to align transportation leading ends of the stacked sheet-shaped media, wherein the left and right detectors are disposed upstream from the leading-end wall in the transportation direction.

19. The feeder according to claim 11, comprising:

a leading-end wall disposed adjacent to a downstream end portion of the mount board in the transportation direction to align transportation leading ends of the stacked sheet-shaped media, wherein the left and right detectors are disposed upstream from the leading-end wall in the transportation direction.

20. The feeder according to claim 11, wherein the components are left and right height limiters that come into contact with upper surfaces of the left and right edge portions of the uppermost sheet-shaped medium that is raised with air flow from the left and right edge air blowers to limit height of the left and right edge portions.

* * * * *